US005782178A

United States Patent [19]

Otomo

[11] Patent Number: 5,782,178

[45] Date of Patent: Jul. 21, 1998

[54] STENCIL PRINTER

[75] Inventor: Tomoya Otomo, Sendai, Japan

[73] Assignee: Tohoku Ricoh Co., Ltd., Miyagi-ken, Japan

[21] Appl. No.: 880,493

[22] Filed: Jun. 23, 1997

[30] Foreign Application Priority Data

Jul. 2, 1996 [JP] Japan ..... 8-172571
Apr. 15, 1997 [JP] Japan ..... 9-096947

[51] Int. Cl.[6] ..... B41L 13/00

[52] U.S. Cl. ..... 101/119; 101/120; 101/229

[58] Field of Search ..... 101/115, 116, 101/119, 120, 229, 230, 231

[56] References Cited

U.S. PATENT DOCUMENTS

| | | | |
|---|---|---|---|
| 3,673,958 | 7/1972 | Billiet | 101/119 |
| 4,742,699 | 5/1988 | Nakahara et al. | 101/119 |
| 4,911,069 | 3/1990 | Hayama et al. . | |
| 5,081,924 | 1/1992 | Ohinata . | |
| 5,357,856 | 10/1994 | Hasegawa et al. | 101/120 |
| 5,555,802 | 9/1996 | Ohinata et al. | 101/116 |
| 5,579,689 | 12/1996 | Ohinata et al. | 101/119 |
| 5,601,019 | 2/1997 | Ohinata et al. . | |
| 5,603,260 | 2/1997 | Ohinata et al. . | |

FOREIGN PATENT DOCUMENTS

| | | |
|---|---|---|
| 59-12894 | 1/1984 | Japan . |
| 62-42873 | 2/1987 | Japan . |
| 1-204781 | 8/1989 | Japan . |
| 2-225078 | 9/1990 | Japan . |
| 3-254984 | 11/1991 | Japan . |
| 6-71996 | 3/1994 | Japan . |
| 6-135111 | 5/1994 | Japan . |
| 6-155884 | 6/1994 | Japan . |
| 7-137414 | 5/1995 | Japan . |
| 7-137415 | 5/1995 | Japan . |
| 7-137416 | 5/1995 | Japan . |
| 8-25780 | 1/1996 | Japan . |
| 8-207416 | 8/1996 | Japan . |
| 8-207417 | 8/1996 | Japan . |

*Primary Examiner*—Eugene H. Eickholt
*Attorney, Agent, or Firm*—Oblon, Spivak, McClelland, Maier & Neustadt, P.C.

[57] ABSTRACT

A stencil printer of the present invention is selectively operable in a simplex print mode or a duplex print mode and includes two drums. The drums each has a respective master support on its circumferential surface. The master supports of the two drums are movable into and out of contact with each other without the distance between the shafts of the drums being changed. In the duplex print mode, the master supports contact each other with the intermediary of a paper so as to print images on both sides of the paper at the same time. The printer obviates noise and insures high image quality.

15 Claims, 27 Drawing Sheets

STENCIL PRINTER

BACKGROUND OF THE INVENTION

The present invention relates to a stencil printer selectively operable in a simplex print mode with a perforated master or in a duplex print mode with perforated masters.

Digital printing of the type using a thermosensitive stencil is a convenient printing method extensively used today. In this type of printing method, a thermal head having an array of fine heating elements contacts a thermosensitive stencil. While current is selectively fed to the heating elements in the form of pulses, the stencil is conveyed along a preselected path. As a result, the stencil is perforated by heat in accordance with image data and then cut at a preselected length to turn out a master. The master is wrapped around a drum implemented as a porous hollow cylinder. Ink is transferred from the drum to a paper via the perforations of the master so as to print an image on the paper.

The current trend in the stencil printers art is toward duplex printing, i.e., printing images on both sides of a paper in order to reduce the consumption of papers. It has been customary to effect duplex printing by feeding a paper from a paper feeding section to a printing section, printing an image on one side of the paper, turning the paper upside down, and again feeding the paper to the printing section in order to print an image on the other side of the paper. Such a conventional duplex printing process, however, has the following problems (1)–(3) left unsolved.

(1) Papers driven out and each carrying an image on one side thereof must be again stacked on the paper feeding section. In addition, the papers carrying images on one side thereof must be neatly positioned. Such manual work is time- and labor-consuming.

(2) The ink on the papers or printings is not sufficiently dry just after the printing operation. Therefore, when images are immediately printed on the other sides of the papers, conveyor rollers and a press roller pressed against the images existing on the papers smear or otherwise disfigure the images. It is therefore a common practice to print images on the other sides of the papers on the elapse of several hours or so. Particularly, when the images existing on one side of the papers include solid portions, the papers must be dried over a long period of time, even over to the next day. This is undesirable from the efficiency standpoint.

(3) Because each paper is passed through the printing section twice, the conventional duplex printing consumes twice longer period of time than simplex printing even in net duration.

To solve the above problems, Japanese Patent Laid-Open Publication Nos. 6-71996 and 6-135111, for example, each teaches a stencil printer including a pair of drums facing each other and pressing them against each other in order to produce a duplex printing in a single step. In this type of stencil printer, one of the two drums is angularly movable into contact with the other drum. This kind of scheme, however, brings about another problem that the drums produce noise on contacting each other during printing, and image quality is not stable due to irregular rotation.

SUMMARY OF THE INVENTION

It is therefore an object of the present invention to provide a stencil printer capable of producing a duplex printing of desirable quality in a single step without producing any noise, and capable of producing a simplex printing also.

In accordance with the present invention, a stencil printer includes a first drum including a first flexible master support, a second drum including a second flexible master support and having a circumferential surface adjoining the first drum, a first ink feeding section arranged in the first drum and including a first ink roller capable of rotating in pressing contact with the inner periphery of the first master support, a second ink feeding section arranged in the second drum and including a second ink roller capable of rotating in pressing contact with the inner periphery of the second master support, and a control section for controlling the first and second drums and first and second ink feeding sections. The first ink roller or the second ink roller is supported by the first ink feeding section or the second ink feeding section in such a manner as to be movable between an inoperative position not causing the first and second master supports to contact each other and an operative position causing them to pressingly contact each other. The control section moves, when a paper is passed between the first and second drums for printing, at least one of the first and second ink rollers from the inoperative position to the operative position to thereby bulge the first master support or the second master support. As a result, the first and second master supports are brought into pressing contact with each other with the intermediary of the paper.

Also, in accordance with the present invention, a stencil printer includes a first drum including a first flexible master support, and a second drum including a second flexible master support and having a circumferential surface adjoining the first drum. A first ink feeding section is arranged in the first drum for feeding ink to the first drum. The first ink feeding section includes a first ink roller selectively movable between a first inoperative position preventing the first master support from contacting the second master support and a first operative position bulging the first master support into pressingly contact with the second master support. A second ink feeding section is arranged in the second drum for feeding ink to the second drum. The second ink feeding section includes a second ink roller selectively movable between a second inoperative position preventing the second master support from contacting the first master support and a second operative position bulging the second master support into pressingly contact with the first master support. A first ink roller moving mechanism moves the first ink roller from the first inoperative position to the first operative position while a second ink roller moving mechanism moves the second ink roller from the second inoperative position to the second operative position. A control section causes, when a paper is passed between the first and second drums for printing, the first and second ink roller moving sections to respectively move the first and second ink rollers to the first and second operative positions to thereby bulge the first and second master supports into pressingly contact with each other with the intermediary of the paper.

Further, in accordance with the present invention, a stencil printer includes a first drum including a first flexible master support, a second drum including a second flexible master support and having a circumferential surface adjoining the first drum, a first ink feeding section arranged in the first drum and including a first ink roller capable of rotating in pressing contact with the inner periphery of the first master support, a second ink feeding section arranged in the second drum and including a second ink roller capable of rotating in pressing contact with the inner periphery of the second master support, and a control section for controlling the first and second drums and first and second ink feeding sections. The first ink roller or the second ink roller is supported by the first ink feeding section or the second ink feeding section in such a manner as to be movable between an inoperative position spaced from the inner periphery of the first master support or the second master support and an operative position pressingly contacting the inner periphery. The control section moves, when a paper is passed between the first and second drums for printing, the first ink roller or the second ink roller from the inoperative position to the operative position to thereby bulge the first master support or the second master support. As a result, the first and second master supports are brought into pressing contact with each other with the intermediary of the paper.

Moreover, in accordance with the present invention, a stencil printer includes a first drum including a first flexible master support, a second drum including a second flexible master support and having a circumferential surface adjoining the first drum. A first ink feeding section is arranged in the first drum for feeding ink to the first drum. The first ink feeding section includes a first ink roller selectively movable between a first inoperative position preventing the first master support from contacting the second master support and a first operative position bulging the first master support into pressingly contact with the second master support. A second ink feeding section is arranged in the second drum for feeding ink to the second drum. The second ink feeding section includes a second ink roller selectively movable between a second inoperative position preventing the second master support from contacting the first master support and a second operative position bulging the second master support into pressing contact with the first master support. A first ink roller moving mechanism moves the first ink roller from the first inoperative position to the first operative position while a second ink roller moving mechanism moves the second ink roller from the second inoperative position to the second operative position. A drum support member is removably mounted to the casing of the stencil printer, and rotatably supports the first and second drums while removably supporting at least one of them, and allows a press roller unit including a press roller to be loaded in place of the removable drum. A print mode switching section sets up a simplex print mode when the press roller unit is mounted to the drum support member, or sets up a duplex print mode when the first and second drums are mounted to the drum support member. A control section causes, in the simplex print mode and when a paper is passed between the press roller and the other drum for printing, the ink roller moving mechanism assigned to the other drum to move the ink roller of the other drum to the operative position assigned to the ink roller to thereby bulge the master support of the other drum to bulge into pressing contact with the press roller with the intermediary of the paper. The control section causes, in the duplex print mode and when a paper is passed between the first and second drums for printing, the first and second ink roller moving mechanisms to respectively move the first and second ink rollers to the first and second operative positions to thereby bulge the first and second master supports. As a result, the first and second master supports are brought into pressing contact with each other with the intermediary of the paper.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
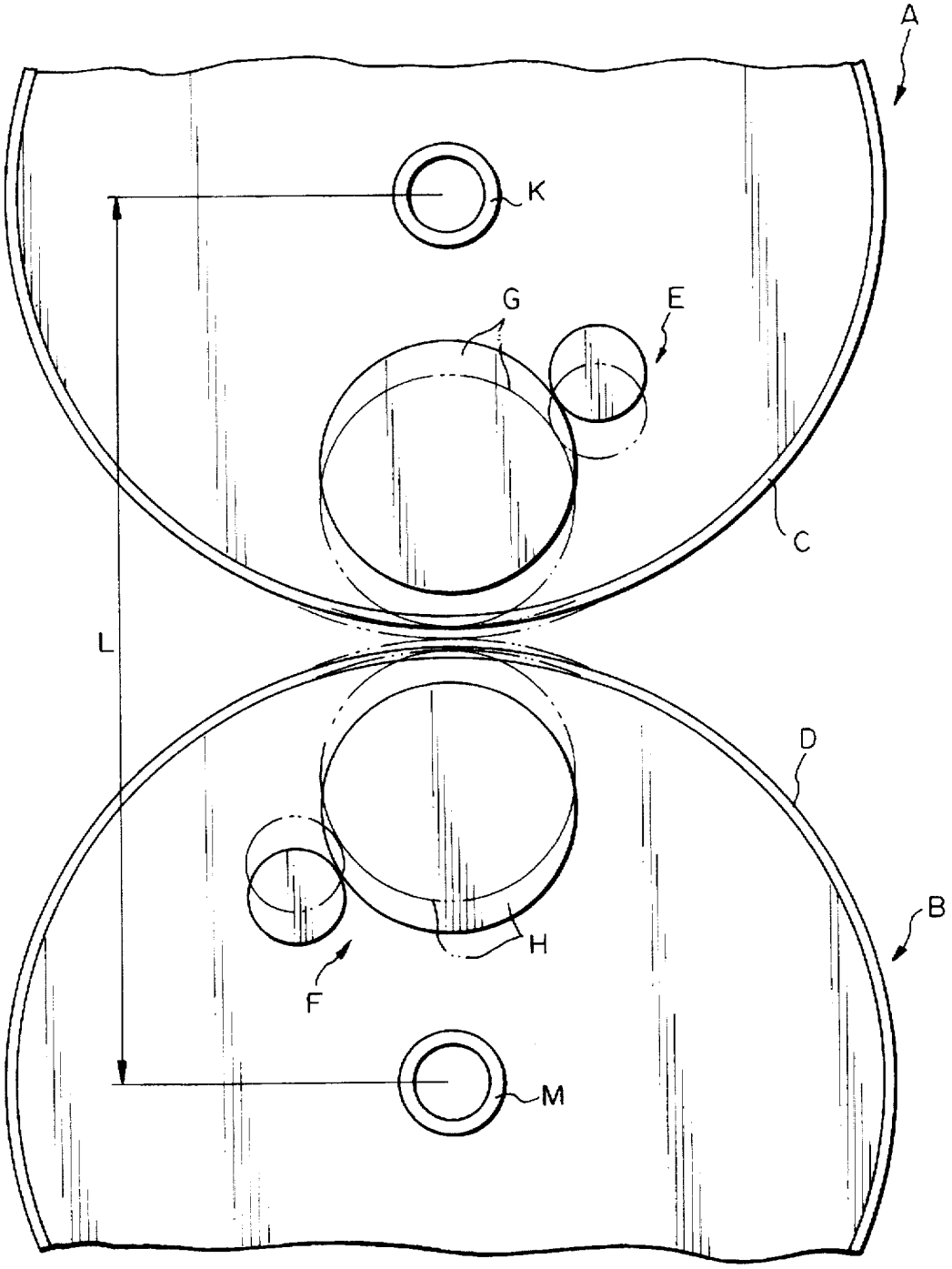
FIGS. 1–3 are side elevations each showing a particular basic configuration of a stencil printer in accordance with the present invention.
Figure 2:
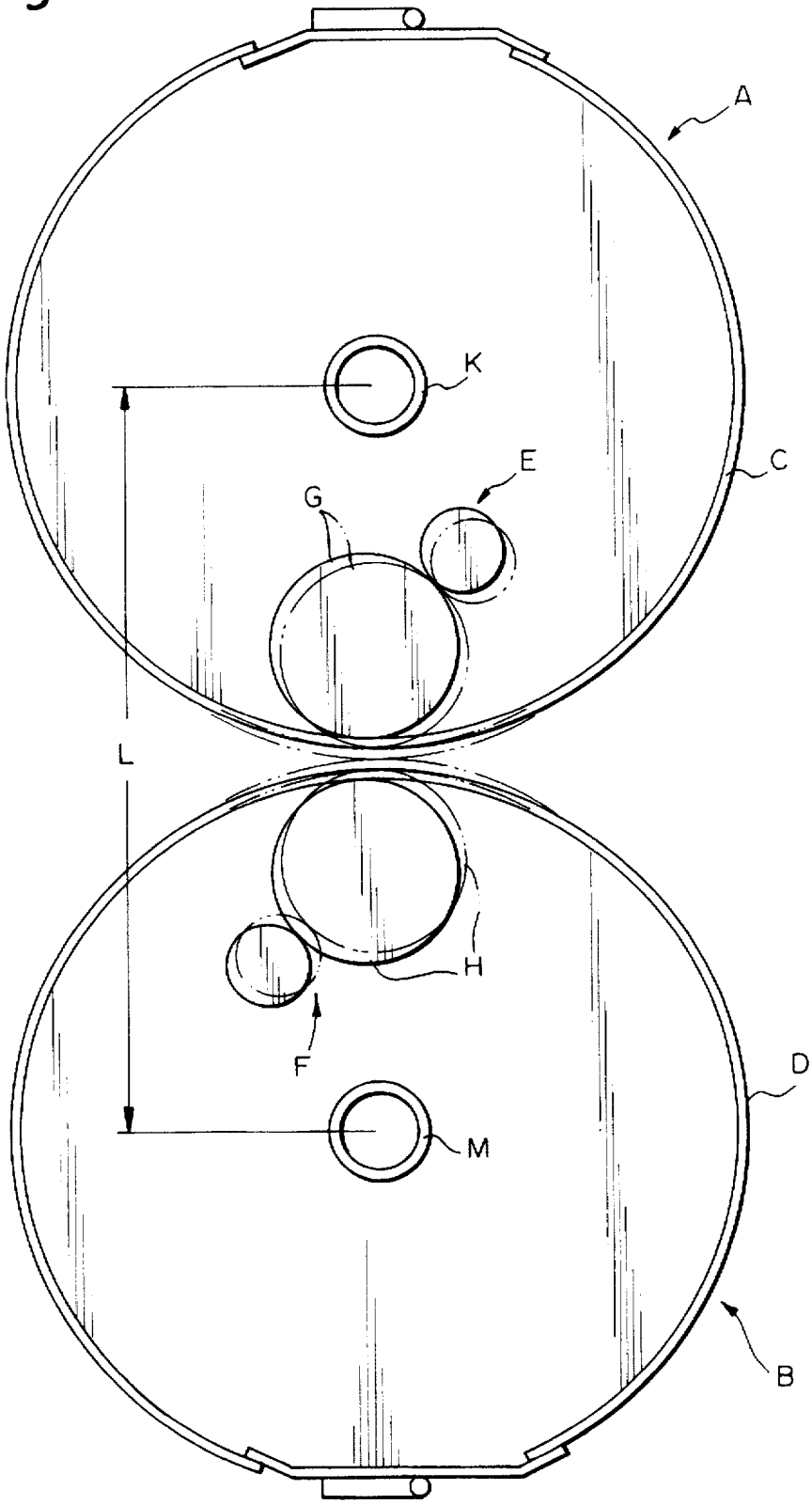
Figure 3:
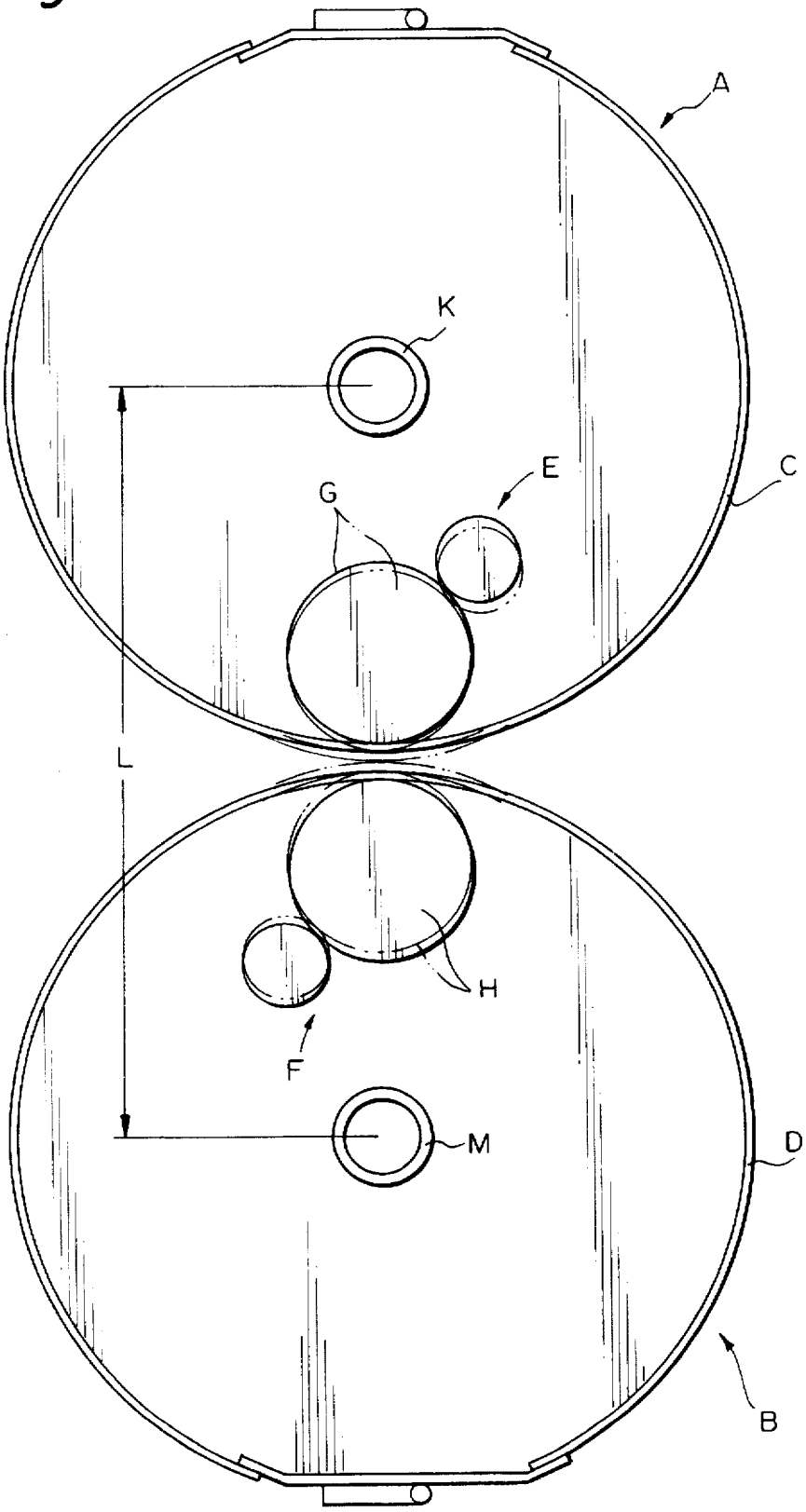

Referring to FIGS. 1, 2 and 3, a basic configuration of a stencil printer in accordance with the present invention will be described. As shown, the stencil printer has a first drum A, a second drum B, first ink feeding means E, and second ink feeding means F. The first drum A includes a first flexible master support C. The second drum B includes a second flexible master support D and has a circumferential surface adjoining the first drum A. The first ink feeding means E is disposed in the first drum A and includes a first ink roller G. The ink roller G is capable of rotating in pressing contact with the inner periphery of the first master support C. The second ink feeding means F is disposed in the second drum B and includes a second ink roller H. The ink roller H is capable of rotating in pressing contact with the inner periphery of the second master support D. At least one of the two ink rollers G and H is supported by the ink feeding means E or F in such a manner as to be movable between an inoperable position (indicated by solid lines in FIGS. 1, 2 and 3) and an operative position (indicated by dash-and-dots lines in FIGS. 1, 2 and 3). In the inoperative position, the ink roller G and/or the ink roller H adjoins or contacts the inner periphery of the associated master support C or D, and the master supports C and D do not contact each other. In the operative position, the ink roller G and/or the ink roller H pressingly contacts the inner periphery of the master support C or D and bulges the master support C or D, causing the two master support C and D to contact each other. When a paper for printing an image thereon is brought between the drums A and B, at least one of the ink rollers G and H is moved from the inoperative position to the operative position so as to bulge at least one of the master supports C and D. As a result, the master supports C and D are pressed against each other with the intermediary of the paper.

In the above configuration, the master supports C and D are movable into and out of contact with each other without varying a distance L between shafts K and M supporting the drums A and B, respectively. Images can be printed on both sides of the paper between the master supports C and D.

Figure 4:
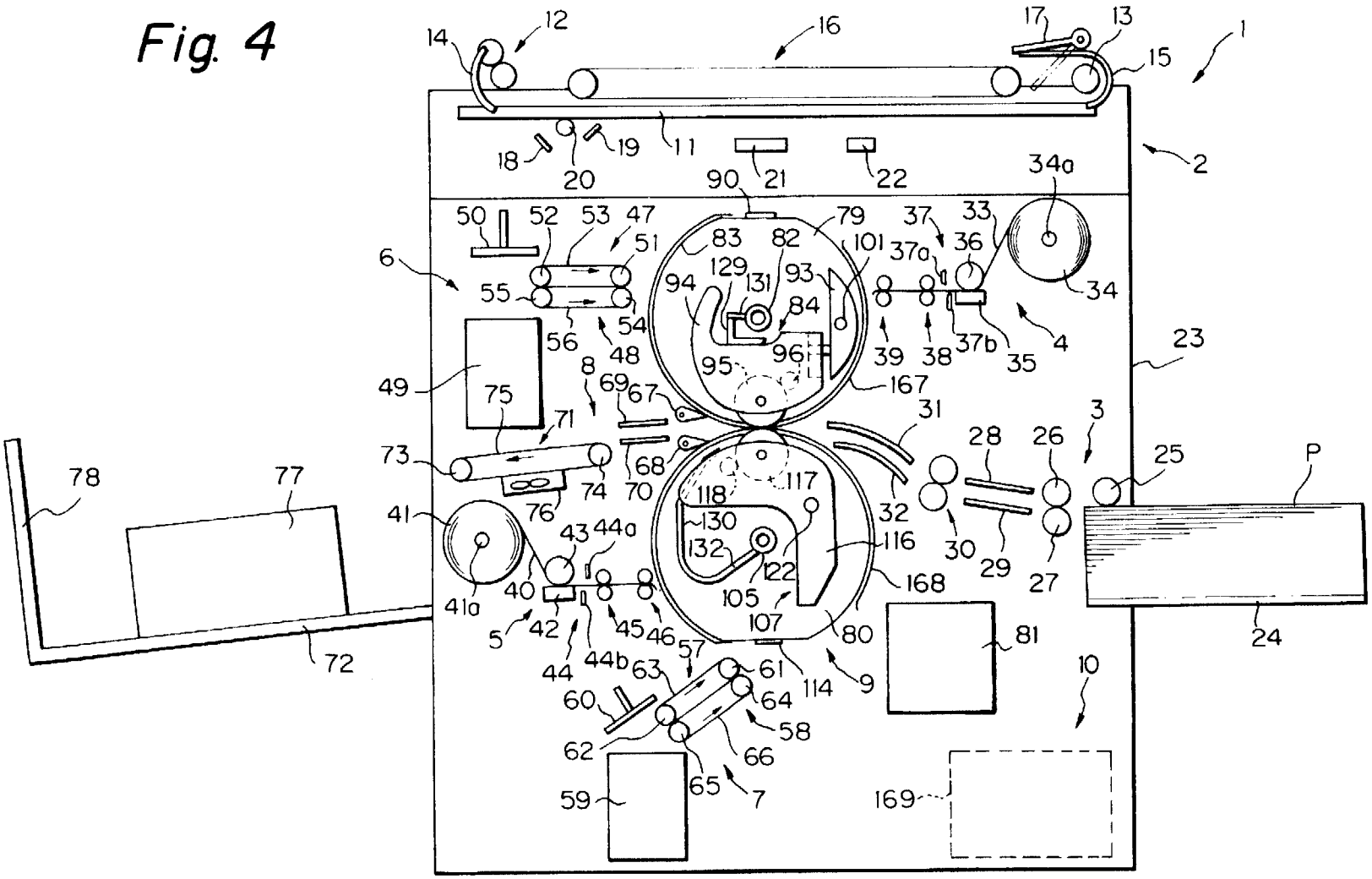
FIG. 4 is a side elevation showing a first embodiment of the stencil printer in accordance with the present invention.

FIG. 4 shows a first embodiment of the stencil printer in accordance with the present invention. As shown, the printer, generally 1, is generally made up of a document scanning section 2, a paper feeding section 3, a first master making section 4, a second master making section 5, a first master discharging section 6, a second master discharging section 7, a paper discharging section 8, a printing section 9, and a control section 10.

The document scanning section 2 is provided on the top of a casing 23 and includes a glass platen 11. A conveyor roller pair 12 and a conveyor roller 13 convey a document while guides 14 and 15 guide the document being conveyed. A conveyor belt 16 conveys the document along the glass platen 11. A switching plate 17 switches the direction in which the document scanned is to be driven out of the scanning section 2. Mirrors 18 and 19 and a light source in the form of a fluorescent lamp 20 scan the document in order to read an image. A lens 21 focuses the resulting imagewise reflection from the document onto a CCD (Charge Coupled Device) array or similar image sensor 22.

The paper feeding section 3 is located in the right intermediate portion of the casing 23 and includes a tray 24 loaded with a stack of papers P. A pick-up roller 25 and a pair of separator rollers 26 and 27 cooperate to feed the papers P out of the tray 24 one by one. Guides 28 and 29 guide the paper P fed from the tray 24. A registration roller pair 30 nips the leading edge of the paper P and then drives the paper P at a preselected timing. Guides 31 and 32 guide the paper P being driven by the registration roller pair 30.

The first master making section 4 is positioned above the paper feeding section 3 and includes a stencil 33 implemented as a roll 34. A thermal head 35 cuts, or perforates, the stencil 33 by heating it. A platen roller 36 conveys the stencil 33 while pressing it against the thermal head 35, and constitutes first master making means together with the thermal head 35. Cutting means 37 cuts the stencil 33 at a preselected length. Conveyor roller pairs 38 and 39, constituting first stencil conveying means, convey the stencil 33. The roll 34 has its core portion 34*a* rotatably supported by a support member not shown. The platen roller 36 is rotated by a stepping motor not shown. The cutting means 37 has a movable edge 37*a* and a stationary edge 37*b*. The edge 37*a* is rotatable or movable up and down relative to the edge 37*b*.

The second master making section 5 is arranged in the left intermediate portion of the casing 23. The master making section 5, like the master making section 4, includes a stencil 40 implemented as a roll 41. The roll 41 has its core portion 41*a* rotatably supported by a support member not shown. A thermal head 42 perforates the stencil 40 paid out from the roll 41. A platen roller 43 is rotated by a stepping motor, not shown, and constitutes second master making means together with the thermal head 42. Cutting means 44 has a movable edge 44*a* and a stationary edge 44*b*. Conveyor roller pairs 45 and 46 constitute second stencil conveying means.

The first master discharging section 6 is disposed above the second master making section 5 and includes an upper and a lower master discharge member 47 and 48, a box 49 for collecting used masters, and a compressing plate or compressor 50. The upper master discharge member 47 has a drive roller 51, a driven roller 52, and an endless belt 53 passed over the rollers 51 and 52. The drive roller 51 is caused to rotate clockwise, as viewed in FIG. 4, while moving the belt 53 in the direction indicated by an arrow in FIG. 4. Likewise, the lower master discharge member 48 has a drive roller 54, a driven roller 55, and an endless belt 56 passed over the rollers 54 and 55. The drive roller 54 is caused to rotated counterclockwise, as viewed in FIG. 4, while moving the belt 56 in the direction indicated by an arrow in FIG. 4. Moving means, not shown, selectively moves the lower master discharge member 48 to a position shown in FIG. 4 or to a position where the circumferential surface of the drive roller 54 contacts the outer periphery of a drum 79 which will be described. The box 49 is removably mounted on the casing 23. The compressor 50 is movable up and down in order to compress a used master introduced into the box 49 by being driven by lifting/lowering means not shown.

The second master discharging section 7 is located at the left-hand side and below the second master making section 5. The discharging section 7, like the discharging section 6, includes an upper and a lower master discharge member 57 and 58, a box 59, and a compressor 60. The master discharge members 57 and 58 respectively have drive rollers 61 and 64, driven rollers 62 and 65, and endless belts 63 and 66. The drive rollers 61 and 64 are rotatable to move the belts 63 and 66, respectively, in the directions indicated by arrows in FIG. 4. Moving means, not shown, selectively moves the lower master discharge member 58 to a position shown in FIG. 4 or to a position where the circumferential surface of the drive roller 64 contacts the outer periphery of a drum 80 which will be described. The box 59 is removably mounted on the casing 23. The compressor 60 is movable up and down in order to compress a used master introduced into the box 59 by being driven by lifting/lowering means not shown.

The paper discharging section 8 is disposed between the second master making section 5 and the first master discharging section 6. The paper discharging section 8 includes peelers 67 and 68, guides 69 and 70, a conveyor member 71, and a tray 72. The peeler 67 is rotatably supported by side walls, not shown, of the casing 23 and peels off the printed paper or printing P from the outer periphery of the drum 79. The edge of the peeler 67 is movable toward and away from the drum 79. Likewise, the other peeler 68 is supported by the above side walls and movable toward and away from the drum 80. The guides 69 and 70 are affixed to the side walls of the casing 23 in order to guide the printing P peeled off by the peeler 67 or 68. The paper conveyor member 71 is made up of a drive roller 73, a driven roller 74, an endless belt 75, and a suction fan 76. While the suction fan 76 sucks the paper P onto the belt 75, the drive roller 73 is rotated to cause the belt 75 to convey the paper or printing P toward the tray 72 in the direction indicated by an arrow in FIG. 4. The tray 72 for stacking such printings P threreon has a pair of side fences 77 and an end fence 78. The side fences 77 are movable in the widthwise direction of the paper P (perpendicularly to the direction of paper conveyance). The tray 72 can be folded and received in the casing 23.

The printing section 9 is arranged at the center of the casing 23 and includes the drum or first drum 79, the drum or second drum 80, and drum driving means 81. The drum 79 is mounted on a shaft 82 which plays the role of an ink feed pipe at the same time. The drum 79 has a porous support or first master support 83 on its circumference. Ink feeding means or first ink feeding means 84 and ink roller moving means or first ink roller moving means 91 (see FIGS. 8 and 10) are disposed in the drum 79.

Figure 5:
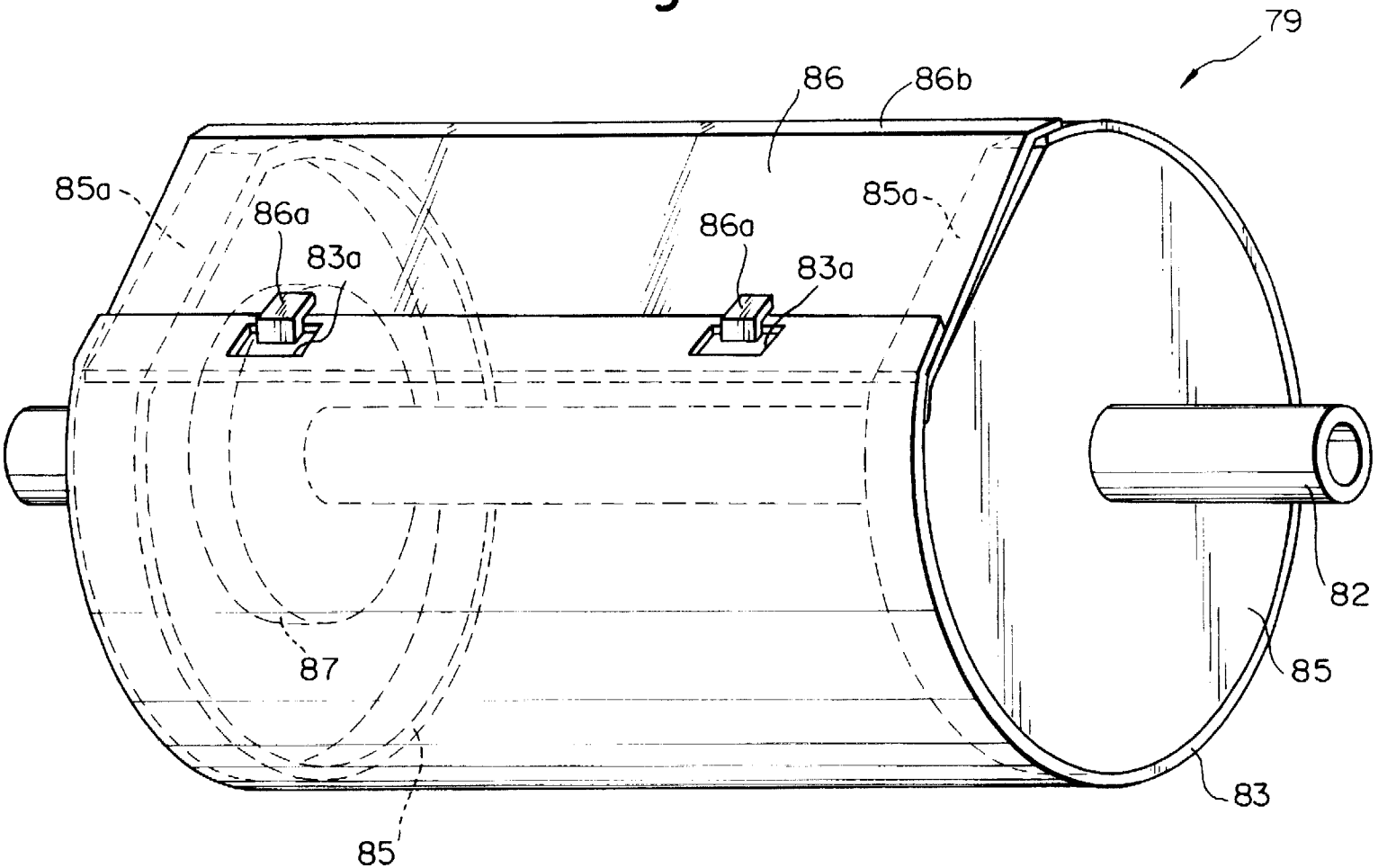
FIG. 5 is a perspective view of a drum included in the first embodiment.
Figure 7:
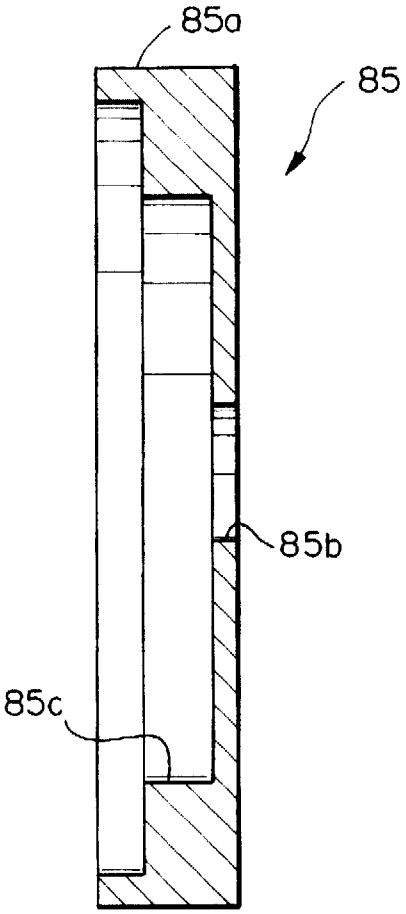
FIG. 7 is a side elevation showing the flange.
Figure 6:
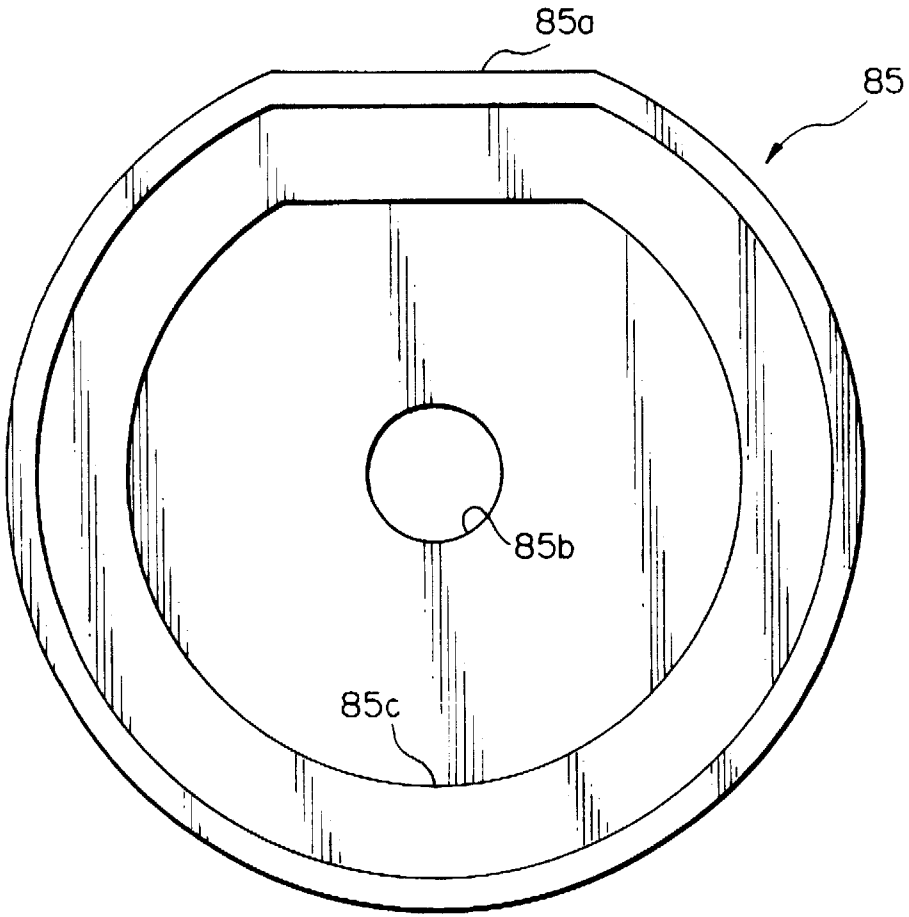
FIG. 6 is a front view of a flange included in the embodiment.
Figure 8:
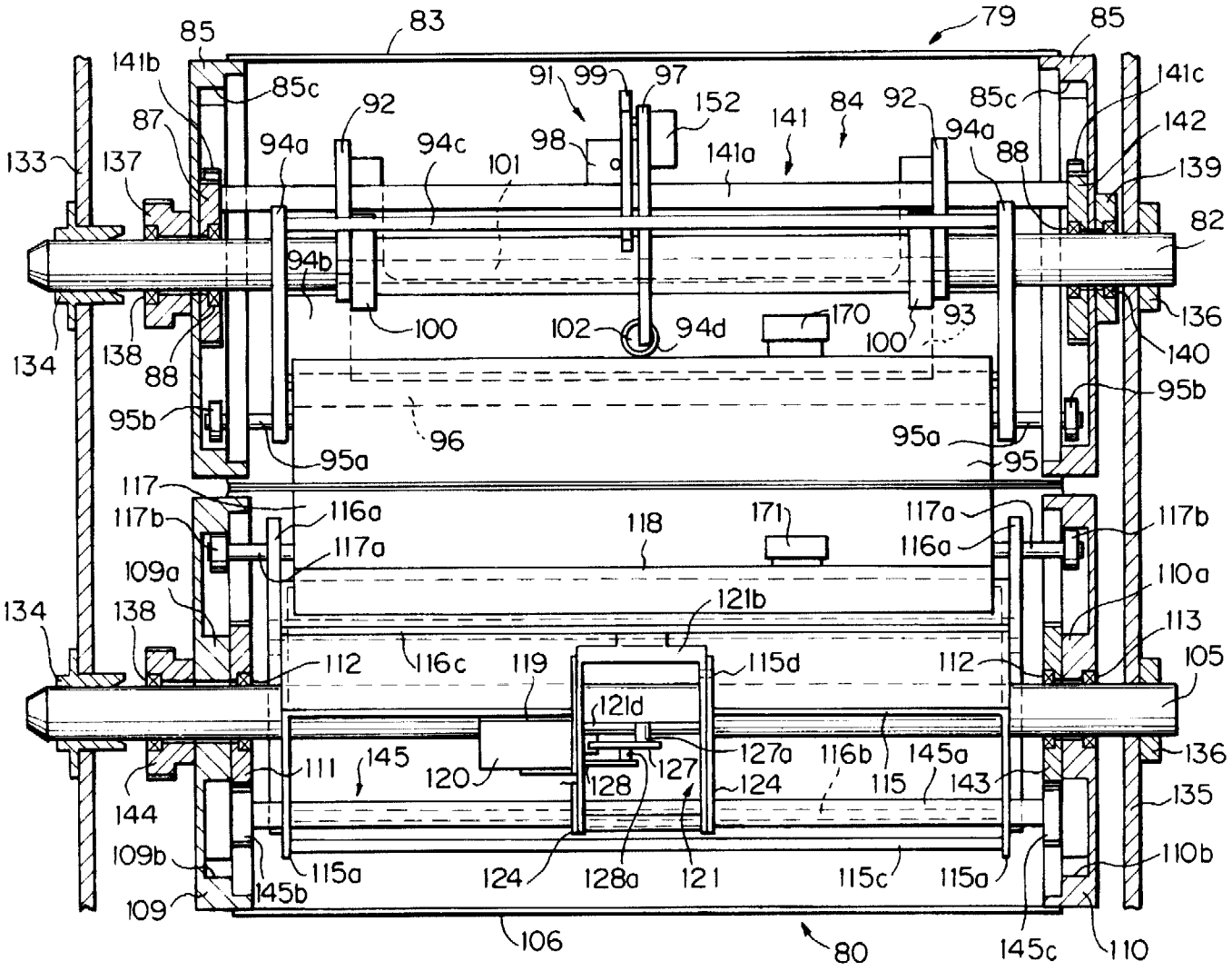
FIG. 8 is a partly sectional view of the essential part of a printing section included in the embodiment.

As shown in FIG. 5, a pair of flanges 85 are rotatably mounted on opposite end portions of the shaft 82 via bearings, and are symmetrical in the right-and-left direction. As best shown in FIGS. 6 and 7, the flanges 85 each has a flat portion **85*a* in a part of its circumference and has a hole 85*b* at its center. The hole 85*b* is greater in diameter than the shaft 82. A cam portion 85*c* is formed in the inner periphery of the flange 85 and similar in configuration to the contour of the flange 85. As shown in FIG. 8, identical gears 87 and 142 are respectively mounted on the flanges 85 within the cam portions 85*c*. The flanges 85 are rotatably mounted on the shaft 82 via bearings 88 respectively mounted on the gears 87 and 142. As shown in FIG. 5, the flanges 85 are positioned on the shaft 82 such that their flat portions 85*a* lie in the same plane. A stage 86 has a bent portion 86*b* at one end thereof and is affixed to the flat portions 85*a* by, e.g., screws. Two hooks 86*a* are positioned on the stage 86** and spaced from each other by a preselected distance.

The porous support 83 is wrapped around the flanges 85 and contacts them with its opposite side edge portions. The support 83 is implemented as a thin sheet of metal formed with a number of pores. Holes **83*a* are formed in the leading edge portion of the support 83 at positions corresponding to the hooks 86*a* of the stage 86. The support 83 has the holes 83*a* caught by the hooks 86*a* and has its trailing edge portion nipped between the circumferential edges of the flanges 85 and the bent portion 86*b* of the stage 86. In this configuration, when a stress acts on the support 83 radially from the inside of the drum 79, the circumference of the support 83 is easily bulged over the circumferences of the flanges 85**.

Figure 9:
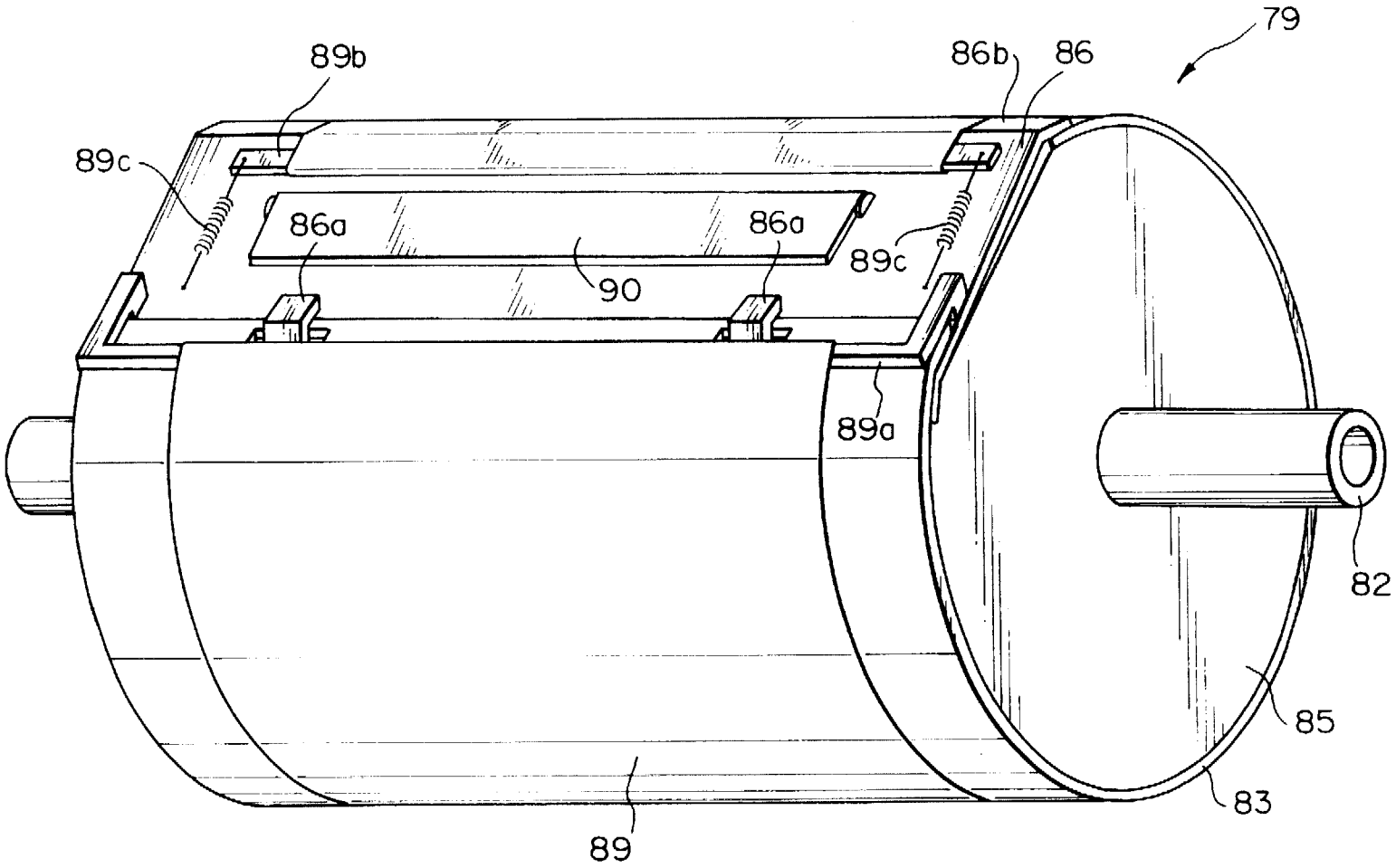
FIG. 9 is a perspective view showing the drum more specifically.

As shown in FIG. 9, a mesh screen 89 is wrapped around the support 83 and formed of resin or metal. The mesh screen 89 has a thin flat fixing plate **89*a* at one end and has a thin movable plate 89*b* at the other end. The fixing plate 89*a* is affixed to the stage 86 by, e.g., screws while the movable plate 89*b* is movably held by the stage 86 via tension springs 89*c*. The mesh screen 89 is therefore capable of protruding outward over the circumferences of the flanges 85. A damper 90 for clamping the leading edge of the perforated stencil or master 33 is provided on the stage 86. Specifically, the damper 90 is rotatably supported by the stage 86 at one end and provided with a magnet, not shown, at the other end or free end. This allows the damper 90 to magnetically adhere to the stage 86, as needed. When the drum 79 is set in the casing 23, opening/closing means, not shown, opens and closes the damper 90** at a preselected position.

Figure 10:
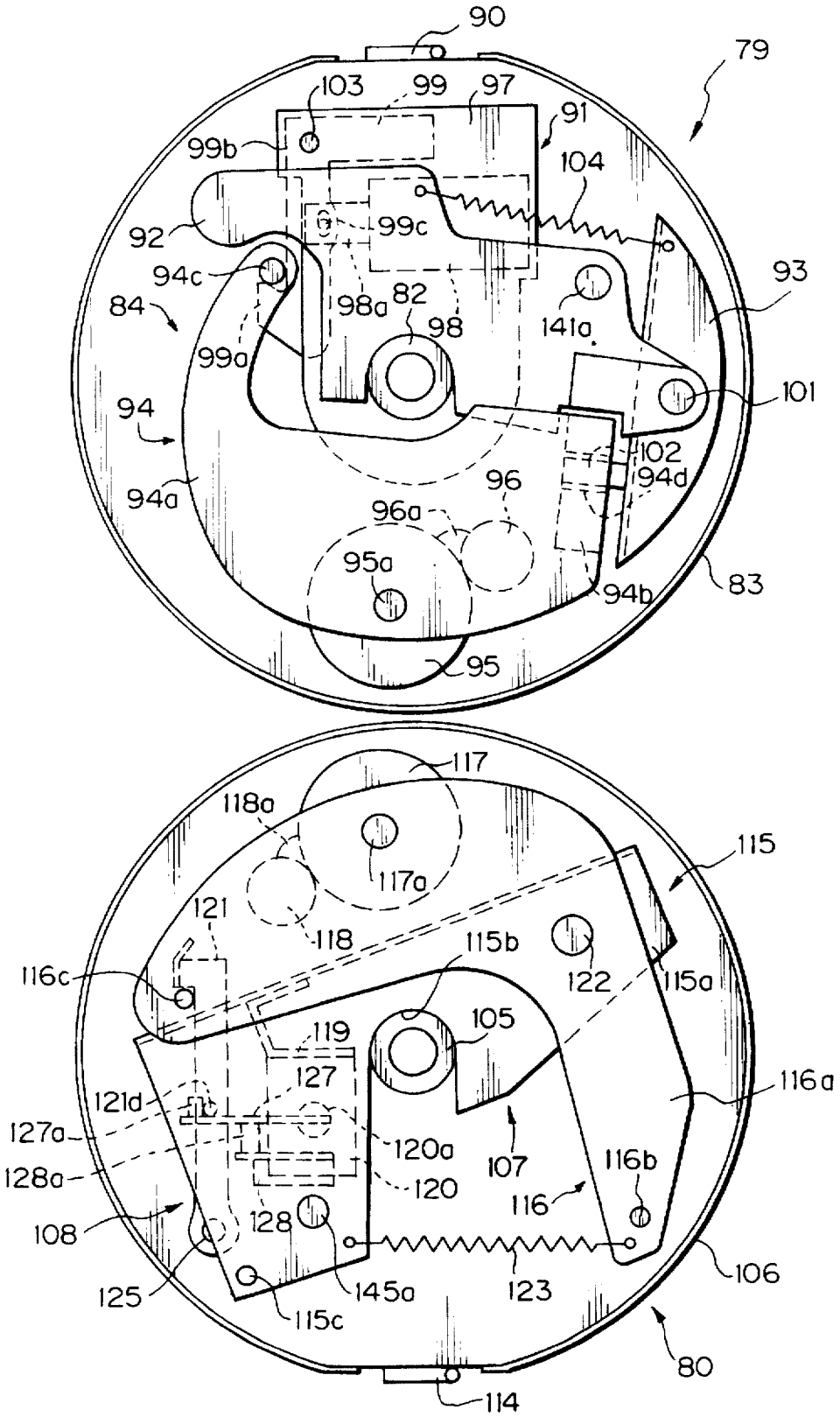
FIG. 10 is a side elevation showing the essential part of the printing section in a non-printing condition.

As shown in FIGS. 8 and 10, the ink feeding means 84 and ink roller moving means 91 are disposed in the drum 79. The ink feeding means 84 includes two flat bases 92, a first support member 93, a second support member or ink roller support member 94, an ink roller or first ink roller 95, and a doctor roller 96. The ink roller moving means 91 includes a support plate 97, a solenoid 98, and a stop 99. The bases 92 are mounted on the shaft 82 at a preselected distance from each other and affixed to the shaft 82 by two affixing members 100.

Figure 11:
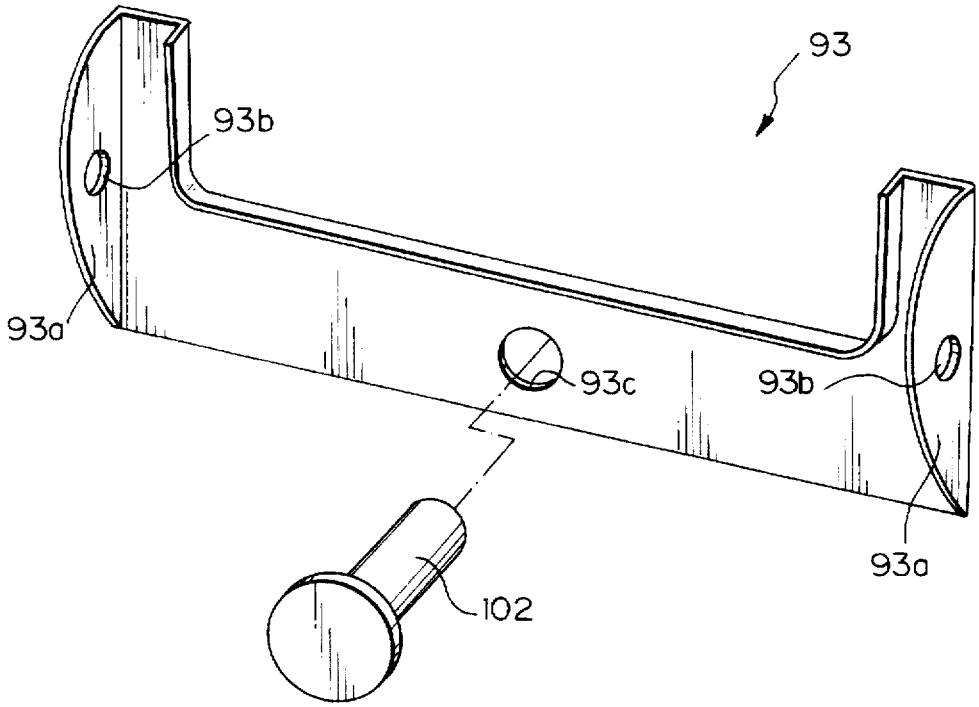
FIG. 11 is a perspective view of a first support member applicable to any one of the first embodiment to a third embodiment of the present invention.

The first support member 93 is interposed between the two bases 92. As shown in FIG. 11, the support member 93 has ears **93*a* at both ends thereof. The ears 93*a* each has a hole 93*b* formed therein. A hole 93*c* is formed in the intermediate portion of the support member 93. A shaft 102 is passed through and affixed in the hole 93*c*. The support member 93 is supported by the bases 92 to be rotatable about a shaft 101 passed through the holes 93*b*. Tension springs 104 are anchored to one of the bases 92 at one end and to the support member 93 at the other end. The tension springs 104 constantly bias the support member 93 such that the member 93 tends to rotate about the shaft 101 counterclockwise, as viewed in FIG. 10. The force of the tension springs 104 is selected to be greater than the force of the tension springs 89*c***.

The second support member 94 includes two side plates **94*a* located outside of the bases 92, a reinforcing member 94*b* connecting the side plates 94*a*, and a lock rod 94*c* extending between the side plates 94*a*. The support member 94 is angularly movably supported by the shaft 102 via a bearing 94*d* mounted on the intermediate portion of the reinforcing member 94*d***.

The ink roller 95 is interposed between and rotatably supported by the side plates **94*a* via a shaft 95*a* and caused to rotate in the same direction as the drum 79 by driving means, not shown. Cam followers 95*b* are mounted on both ends of the shaft 95*a* and respectively held in contact with the cam portions 85*c* of the flanges 85. When the cam followers 95*b* contact projections included in the cam portions 85*c*, the circumferential surface of the ink roller 95 is released from the inner periphery of the porous support 83. When the cam followers 95*b* move away from the above projections, the circumference of the ink roller 95 protrudes outward over the circumferences of the flanges 85**.

The doctor roller 96 adjoins the ink roller 95 and is rotatably supported by the side plates **94*a*. Driving means, not shown, causes the doctor roller 96 to rotate in the opposite direction to the ink roller 95. The circumferential surface of the ink roller 95 and that of the doctor roller 96 form a wedge-like ink well 96*a* therebetween, as illustrated. Ink fed via the shaft 82 and an ink feed pipe 129, which will be described, drops into the ink well 96*a***.

A sensor or ink sensing means 170 is positioned above the ink well **96*a* in order to sense the amount of the ink existing in the well 96*a*. The sensor 170 is affixed to one of the side plates 94*a*** by an affixing member, not shown.

The support plate 97 is affixed to the shaft 82 at substantially the intermediate between the bases 92 by affixing members, not shown, similar to the previously mentioned affixing members 100. The solenoid 98 and stop 99 and a sensor 152 are mounted on the support plate 97.

As shown in FIG. 10, the stop 99 has a generally L-shaped configuration. One end 99*a* of the stop 99 is bent outward in a hook-like shape and engageable with the lock rod 94*c*. The bent portion 99*b* of the stop 99 is rotatably supported by the support plate 97 via a shaft 103. The solenoid 98 has a plunger 98*a* received in a slot 99*c* formed in the stop 99 between the end 99*a* and the bent portion 99*b*. Biasing means, not shown, constantly biases the stop 99 such that the stop 99 tends to rotate about the shaft 103 clockwise, as viewed in FIG. 10. The sensor 152 is implemented by a microswitch and senses the position of the ink roller 95 on the basis of the position of the lock rod 94*c*.

As shown in FIGS. 8 and 10, the drum 80 is positioned beneath the drum 79 and has a shaft 105 playing the role of an ink feed pipe at the same time at its center. A porous support or second master support 106 is wrapped around the drum 80. Ink feeding means or second ink feeding means 107 and ink roller moving means or second ink roller moving means 108 are disposed in the drum 80. The drum 80 is positioned such that the outer periphery of the porous support 106 is spaced from the outer periphery of the porous support 83 by a preselected distance (about 2 mm to 3 mm).

Flanges 109 and 110 substantially identical in configuration with the flanges 85 are rotatably mounted on opposite end portions of the shaft 105 via bearings and symmetrical to each other in the right-and-left direction. As shown in FIG. 8, the flanges 109 and 110 are different from the flanges 85 in that they are respectively formed with bosses 109*a* and 110*a* at their inner radially central portions. The flanges 109 and 110, like the flanges 85, include flat portions, not shown, and cam portions 109*b* and 110*b*, respectively. Identical gears 111 and 143 are respectively mounted on the bosses 109*a* and 110*a*. The flange 109 is rotatably mounted on the shaft 105 via a bearing 112 mounted on the gear 111. The flange 110 is rotatably mounted on the shaft 105 via a bearing 112 mounted on the bear 143 and a bearing 113 mounted on the flange 110. The flat portions of the flanges 109 and 110 are coplanar with each other. A stage is affixed to the flat portions and includes hooks, not shown, and a damper 114. The support 106 and a mesh screen, not shown, are wrapped around the flanges 109 and 110 and capable of protruding outward over the circumferences of the flanges 109 and 110.

The ink feeding means 107 and ink roller moving means 108 are disposed in the drum 80. The ink feeding means 107 includes a base 115, an ink roller support member 116, an ink roller or second ink roller 117, and a doctor roller 118. The ink roller moving means 108 includes a support member 119, a solenoid 120, and a stop 121.

Figure 12:
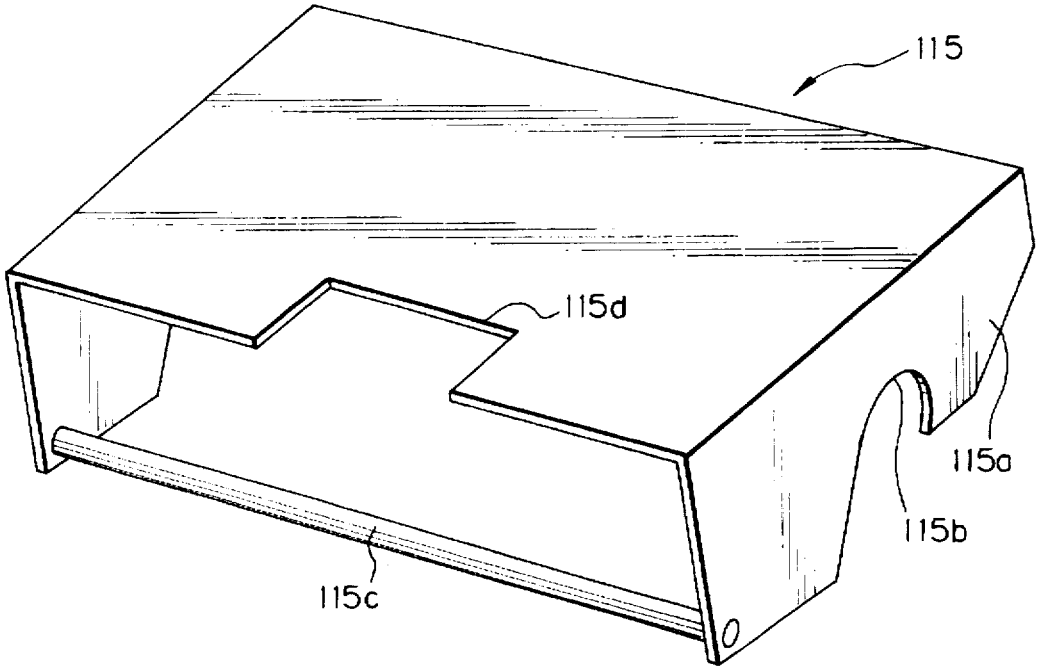
FIG. 12 is a perspective view of a base applicable to any one of the first to third embodiments.

As shown in FIG. 12, the base 115 has opposite side walls 115*a* each being formed with a generally U-shaped notch 115*b* for receiving the shaft 105. A reinforcing member 115*c* extends between the side walls 115*a* in order to prevent them from falling down. A notch 115*d* is formed in the front intermediate portion of the base 115. The base 115 is affixed by an affixing member, not shown, with the notches 115*b* receiving the shaft 105.

As shown in FIG. 8 and 10, the ink roller support member 116 includes two side walls 116*a* located outside of the side walls 115*a*, a tie rod 116*b* connecting the side walls 116*a*, and a lock rod 116*c* extending between the side walls 116*a*. The support member 116 is angularly movably supported by the base 115 via a shaft 122. Tension springs 123 are anchored to the base 115 at one end and to the support member 116 at the other end. The tension springs 123 constantly biases the support member 116 such that the member 116 tends to rotate about the shaft 122 clockwise, as viewed in FIG. 10. The force of the tension springs 123 is selected to be greater than the force of the tension spring 104.

The ink roller 117 is rotatably supported by the side walls 116*a* via a shaft 117*a* and caused to rotate in the same direction as the drum 80 by driving means not shown. Cam followers 117*b* are respectively mounted on opposite ends of the shaft 117*a* and respectively held in contact with the cam portions 109*b* and 110*b*. When the cam followers 117*b* respectively contact projections included in the cam portions 109*b* and 110*b*, the circumferential surface of the ink roller 117 is released from the inner periphery of the porous support 106. When the cam followers 117*b* contact recesses also included in the cam portions 109*b* and 110*b*, the circumference of the ink roller 117 protrude outward over the circumferences of the flanges 109 and 110.

The doctor roller 118 adjoins the ink roller 117. As shown in FIGS. 8 and 10, the doctor roller 118 is rotatably supported by the side walls 116*a*. Driving means, not shown, causes the doctor roller 118 to rotate in the opposite direction to the ink roller 117. The circumferential surface of the ink roller 117 and that of the doctor roller 118 form a wedge-like ink well 118*a* therebetween, as illustrated. Ink fed via the shaft 105 and an ink feed pipe 130 (see FIG. 4), which will be described, drops into the ink well 118*a*. A sensor or ink sensing means 171 is positioned above the ink well 118*a* in order to sense the amount of the ink existing in the well 118*a*. The sensor 171 is affixed to one of the side walls 116*a* by an affixing member not shown.

The support member 119 is formed by bending a sheet material and affixed to the inner periphery of the base 115 by, e.g., screws. The solenoid 120 is mounted on the support member 119.

Figure 13:
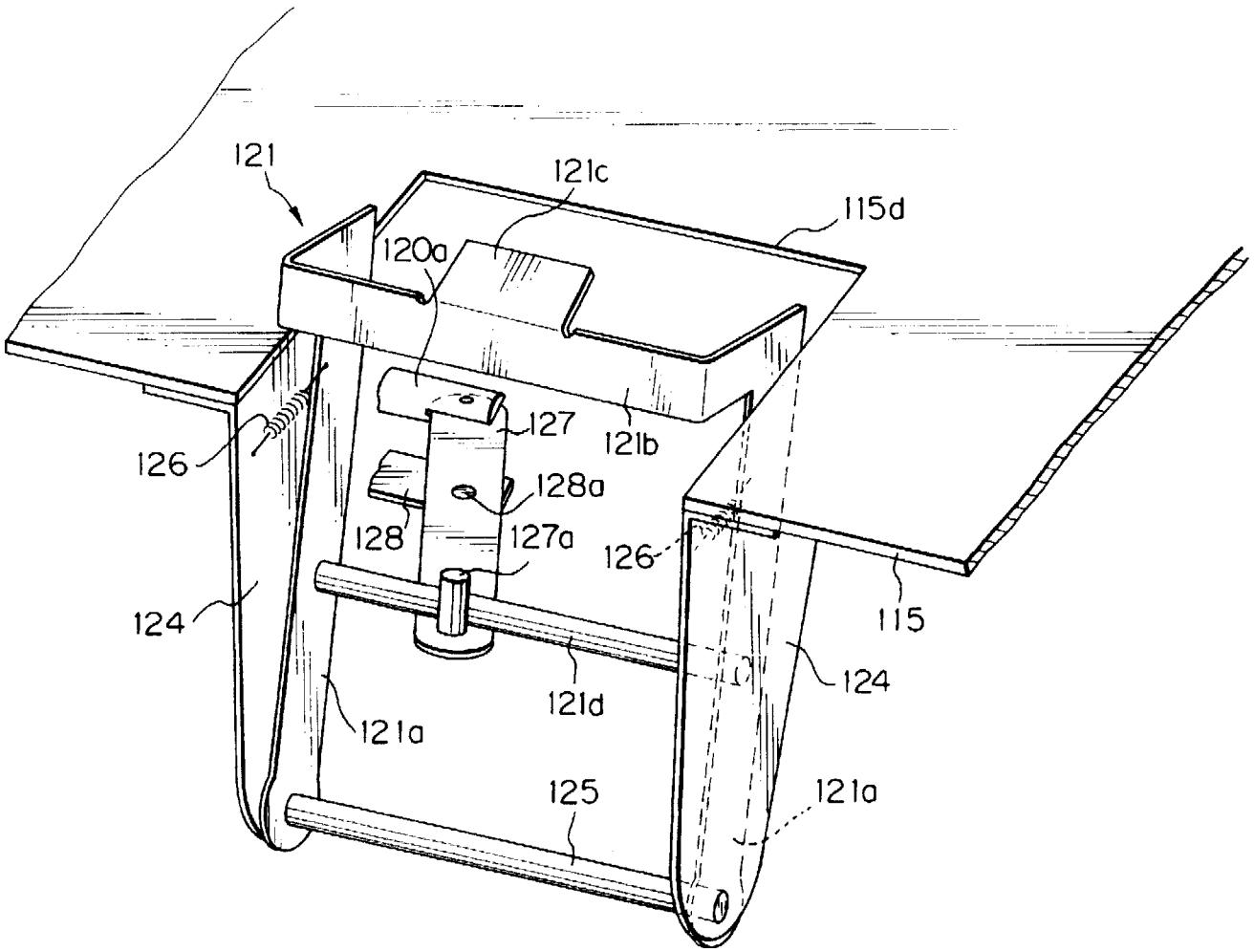
FIG. 13 is a perspective view of a stop applicable to any one of the first to third embodiments.

As shown in FIG. 13, the stop 121 is made up of legs 121*a*, a protruding portion 121*b*, a tongue 121*c*, and a tie rod 121*d*. Brackets 124 are affixed to the base 115 while the legs 121*a* are rotatably supported by the brackets 124 via a shaft 125. Tension springs 126 each is anchored to one of the legs 121*a* at one ends and one of the brackets 124 at opposite ends thereof. In this condition, the stop 121 tends to rotate about the shaft 125 counterclockwise, as viewed in FIG. 10. The protruding portion 121*b* protrudes from the legs 121*a* and is engageable with the lock rod 116*c* at its stepped portions merging into the legs 121*a*. The tongue 121*c* extend out from the protruding portion 121*b* and is so positioned as to abut against the lock rod 116*c* when the ink roller support member 116 rotates. The tie rod 121*d* is affixed to substantially the intermediate portions of the legs 121*a* at opposite ends thereof. An operating piece 127 is rotatably supported by the plunger 120 of the solenoid 120 at one end thereof. A pin 127*a* is studded on the other end of the operating piece 127 and held in engagement with the tie rod 121*d*. The operating piece 127 is rotatably supported by a stub 128*a* provided on an affixing member 128 which is mounted on the solenoid 120.

Figure 14:
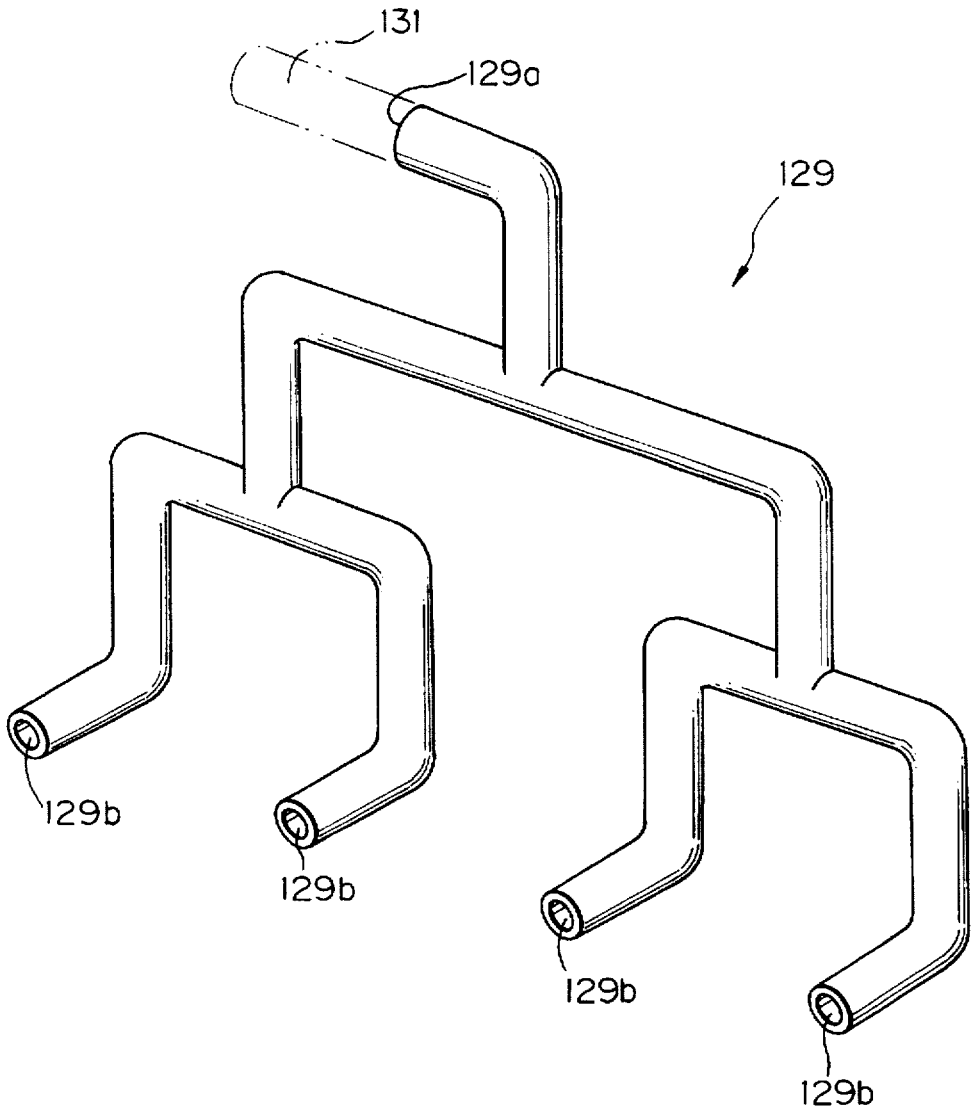
FIG. 14 is a perspective view of an ink feed pipe applicable to any one of the first to third embodiments.

The ink feed pipes 129 and 130 (see FIG. 4) are respectively disposed in the drums 79 and 80 in order to feed ink from the shafts 82 and 105 toward the ink wells 96*a* and 118*a*. As shown in FIG. 14, the pipe 129 is a manifold having a single inlet 129*a* and four outlets 129*b* and is affixed to the shaft 82 by an affixing member not shown. A flexible connecting pipe 131 provides fluid communication between the inlet 129*a* and the shaft 82. An ink pump or first ink supply member, not shown, feeds ink under pressure from an ink pack, not shown, to the ink feed pipe 129 via the shaft 82 and connecting pipe 131. The ink drops from the pipe 129 into the ink well 96*a*.

Figure 15:
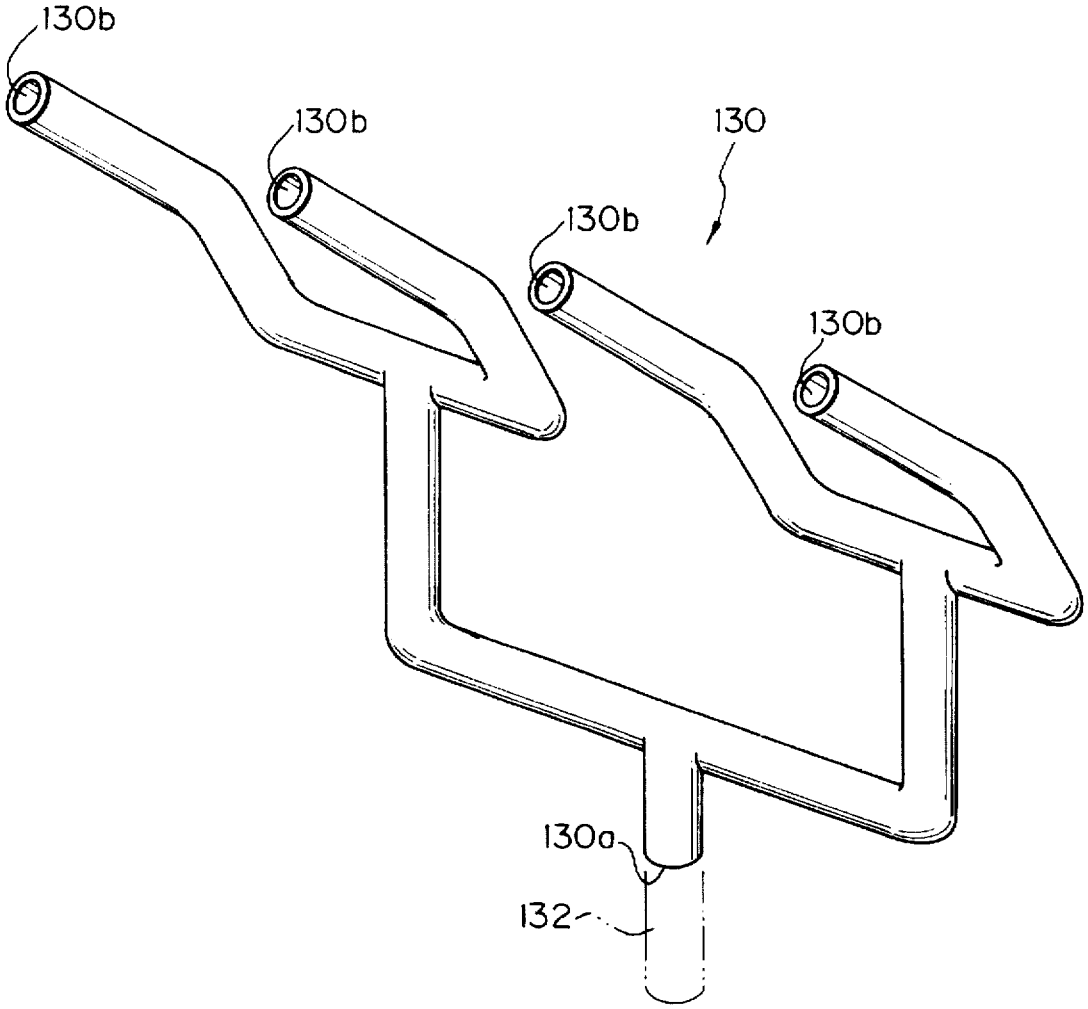
FIG. 15 is a view similar to FIG. 14, showing another ink feed pipe.

As shown in FIG. 15, the pipe 130 is also a manifold having a single inlet 130*a* and four outlets 130*b* and is affixed to the base 115 by an affixing member not shown. A flexible connecting pipe 132 provides fluid communication between the inlet 130*a* and the shaft 105. An ink pump or second ink supply member, not shown, feeds ink under pressure from an ink pack, not shown, to the ink feed pipe 130 via the shaft 105 and connecting pipe 132. The ink drops from the pipe 130 into the ink well 118*a*.

As shown in FIG. 8, positioning members 134 are mounted on a side wall 133 forming a part of the casing 23. The shafts 82 and 105 of the drums 79 and 80, respectively, each is positioned by one of the positioning members 134 at one end thereof. The other end of each shaft 82 or 105 is affixed to a respective affixing member 136 via a side wall 135 which is removable from the casing 23. In this condition, the drums 79 and 80 are positioned relative to the casing 23. Toothed pulleys 137 and 144 are respectively positioned outside of the flanges 85 and 109 mounted on one end of the shafts 82 and 105. The toothed pulleys 137 and 144 are respectively rotatably mounted on the shafts 82 and 105 via bearings 138 and 138 coaxially with the flanges 85 and 109. A spacer 139 is rotatably mounted on the other end of the shaft 82 outside of the other flange 85 via a bearing 140. The spacer 139 forms a gap between the other flange 85 and the side wall 135.

A transmission member 141 is positioned in the drum 79 in order to transfer a torque applied to the toothed pulley 137 from one flange 85 to the other flange 85 via the gear 87 and a gear 142. The transmission member 141 is made up of a shaft 141*a* rotatably supported by the bases 92, and gears 141*b* and 141*c* mounted on opposite ends of the shaft 141*a*. The gears 141*b* and 141*c* are held in mesh with the gears 87 and 142, respectively. A transmission member 145 is disposed in the drum 80 in order to transfer a torque applied to the toothed pulley 144 from the flange 109 to the flange 110 via the gear 111 and a gear 143. The transmission member 145 is made up of a shaft 145*a* rotatably supported by the the side walls 115*a*, and gears 145*b* and 145*c* mounted on opposite ends of the shaft 145*a*. The gears 145*b* and 145*c* are held in mesh with the gears 111 and 143, respectively.

Figure 16:
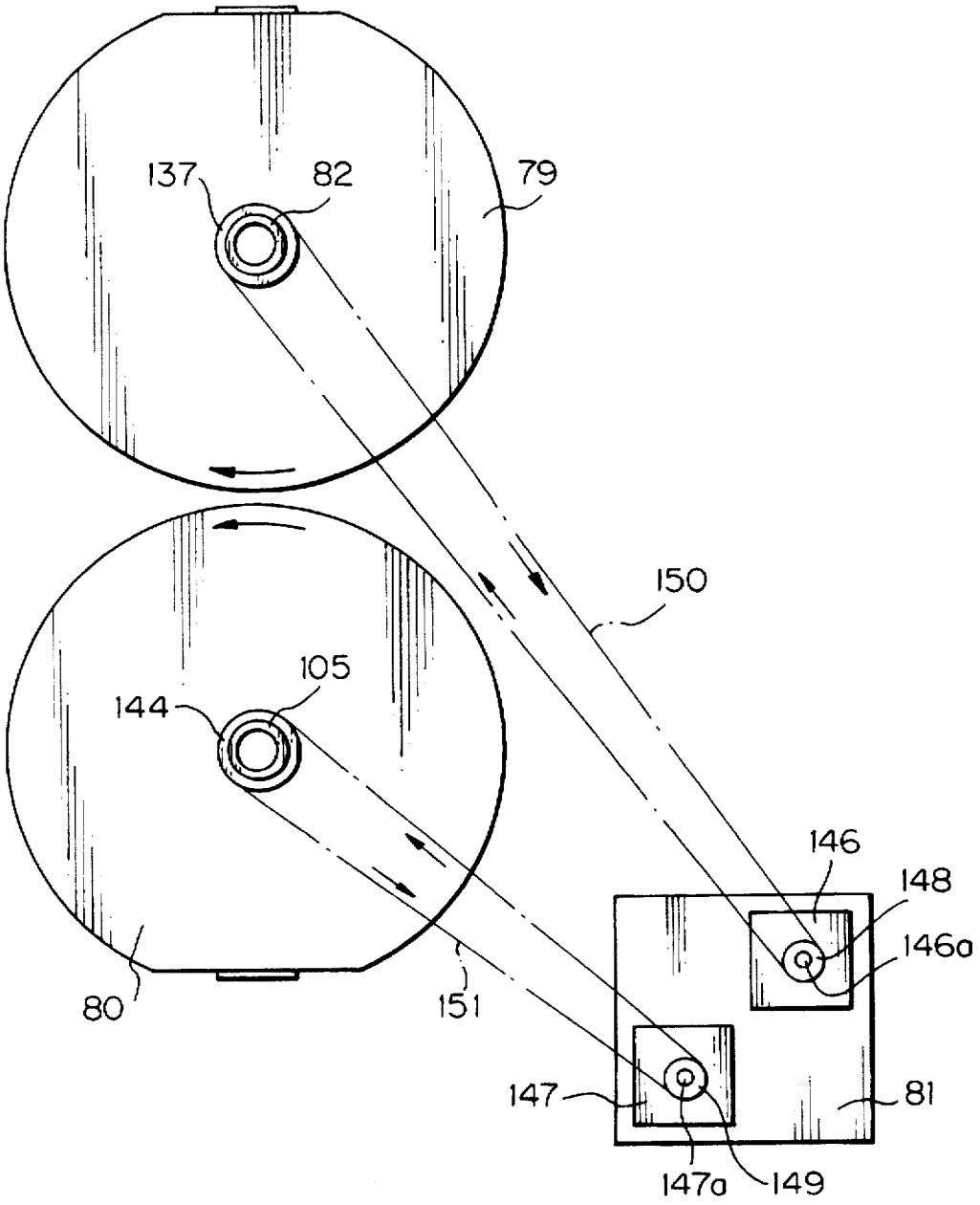
FIG. 16 shows specific drum driving means included in the first embodiment.

Drum driving means 81 is positioned below and at the right-hand side of the drum 80 (see FIG. 4). As shown in FIG. 16 specifically, the drum driving means 81 includes two motors 146 and 147 having output shafts 146*a* and 147*a*, respectively. Toothed pulleys 148 and 149 are mounted on the output shafts 146*a* and 147*a*, respectively. Timing belts 150 and 151 are respectively passed over the toothed pulleys 148 and 137 and over the toothed pulleys 149 and 144. In this configuration, the output torques of the motors 146 and 147 are respectively transferred to the drums 79 and 80, causing them to rotate in synchronism with, but in the opposite direction to, each other.

Figure 19:
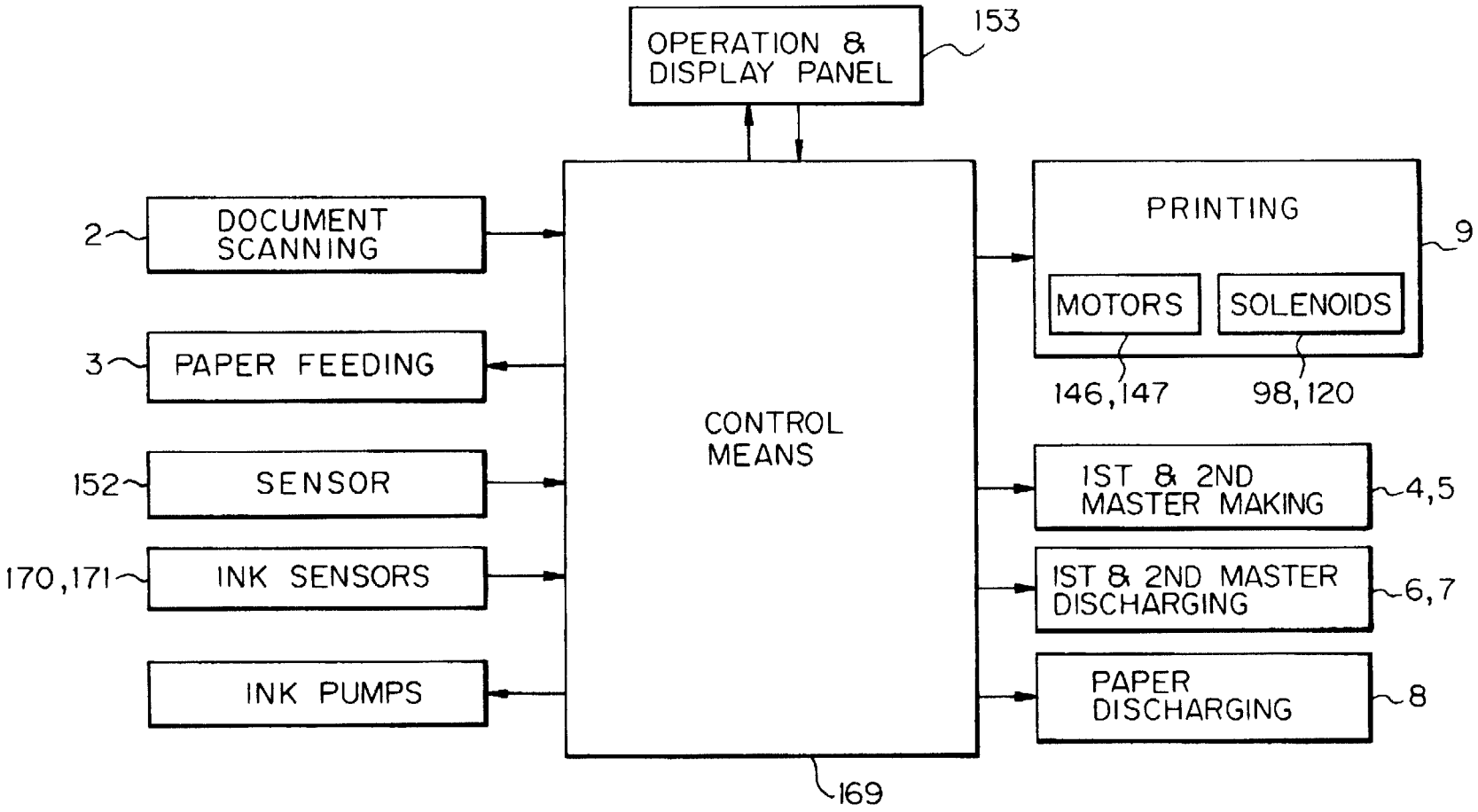
FIG. 19 is a block diagram schematically showing a control section included in the first embodiment.

As shown in FIG. 4, the control section 10 located in the lower portion of the casing 23 includes control means 169. The control means 169 is a conventional microcomputer including a CPU (Central Processing Unit), ROM (Read Only Memory), and RAM (Random Access Memory). The control section 10 controls the operation of the entire printer 1. As shown in FIG. 19, the document scanning section 2, paper feeding section 3, first and second master making sections 4 and 5, first and second master discharging sections 6 and 7, paper discharging section 8, printing section 9, sensor 152, ink sensors 170 and 171 and ink pumps are connected to the control means 169. Also connected to the control means 169 is an operation and display panel 153 mounted on the top front portion of the casing 23.

Figure 17:
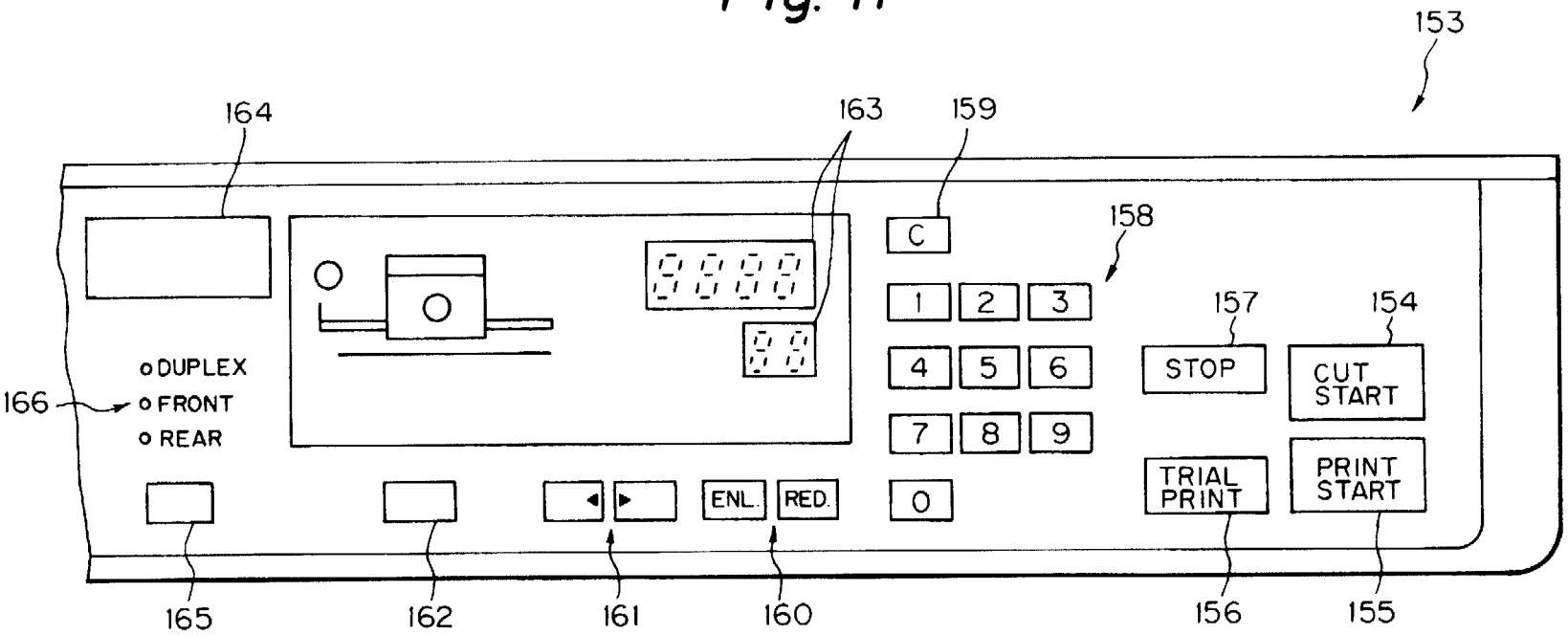
FIG. 17 is a plan view showing a specific configuration of an operation and display panel applicable to any one of the first to third embodiments.

FIG. 17 shows a specific configuration of the operation and display panel 153. As shown, a cut (or perforation) start key 154, a print start key 155, a trial print key 156, a stop key 157, numeral keys 158, a clear key 159, enlarge (ENL) and reduce (RED) keys 160, print speed keys 161, a continuous print key 162, a seven-segment display 163 using LEDs (Light Emitting Elements), an LCD (Liquid Crystal Display) 164 and other conventional components are arranged on the panel 153. Also arranged on the panel 153 are a print mode key 165 for allowing the operator to select a front print mode, a rear print mode or a two-side or duplex print mode, and LEDs 166 each for displaying one of the above modes selected. The print mode key 165 serves as print mode switching means while the LEDs 166 serve as print mode displaying means.

The operation of the printer 1 having the above configuration will be described hereinafter. Before the start of printing operation, the operator selects a desired print mode on the print mode key 165. First, assume that the operator selects the duplex print mode for printing images on both sides of a paper. The operator sets two documents on a document tray, not shown, and the presses the cut start key 154. In response, the motor 146 is energized to cause the drum 79 to rotate counterclockwise. The upper and lower master discharge members 47 and 48 cooperate to peel off a used master 167 from the drum 79 in rotation. The used master 167 is introduced into the box 49 and then compressed by the compressor 50. The motor 147 is energized at the same time as the drum 79 starts rotating. The upper and lower master discharge members 57 and 58 peel off a used master 168 from the drum 80 in rotation. The used master 168 is introduced into the box 59 and then compressed by the compressor 60. After the drums 79 and 80 each has been rotated to a preselected waiting position or home position, they are brought to a stop. This is the end of a master discharging procedure.

After the master discharging procedure, the conveyor roller pair 12 included in the document scanning section 2 starts rotating and conveys the upper document, not shown, along the glass platen 11. While the light source, 20 illuminates the document via the glass platen 11, the resulting imagewise reflection from the document is reflected by the mirrors 18 and 19 and then focused by the lens 21 onto the image sensor 22. The image sensor or photoelectric transducer 22 generates an electric image signal corresponding to the imagewise light incident thereto. The image signal is fed to an analog-to-digital converter, not shown, disposed in the casing 23. The document scanned by the light source 20 is driven out by the conveyor belt 16 and conveyor roller 13 to a tray, not shown, located above the belt 16.

In parallel with the above scanning operation, the first master making section 4 makes a master. Specifically, after the master discharging operation, the platen roller 36 and conveyor roller pairs 38 and 39 start rotating and pay out the master 33 from the roll 34. The stencil 33 is cut, or perforated, while being conveyed via the thermal head 35. A number of heating elements, not shown, are arranged on the surface of the thermal head 35. The digital image signal undergone various kinds of conventional processing including digital-to-analog conversion is applied to the head 35 and selectively causes the heating elements to generate heat.

As a result, a thermoplastic resin film included in the stencil 33 is selectively perforated by heat.

The control means 169 determines, based on the number of steps of the stepping motor assigned to the platen roller 36, whether or not the leading edge of the perforated stencil or master 33 has reached a preselected position between the stage 86 and the damper 90. If the answer of this decision is positive, the control means 169 sends a control signal to the previously mentioned opening/closing means so as to rotate the damper 90. As a result, the damper 90 and stage 86 clamp the leading edge of the master 33.

Subsequently, the drum 79 is rotated clockwise, as viewed in FIG. 4, at a peripheral speed equal to the speed at which the master 33 is conveyed. As a result, the master 33 is sequentially wrapped around the drum 79. When the control means 169 determines, based on the number of the stepping motor, that a single master has been completed, it stops the rotation of the platen roller 36 and conveyor roller pairs 38 and 39. At the same time, the control means 169 causes the movable edge 37*a* to cut the master 33. The cut master 33 is pulled out by the drum 79 in rotation. When the drum 79 again reaches its waiting position or home position, the control means 169 deenergizes the motor 146 and thereby positions the drum 79.

After the above positioning of the drum 79, the conveyor roller pair 12 again starts rotating so as to convey the other or lower document to the glass platen 11. The document is scanned in the previously stated manner and then driven out to the tray. Assume that the scanning section 2 reads images out of both sides of a single document. Then, after one side of such a document has been scanned, the conveyor belt 16 and conveyor roller 13 are rotated while the switching plate 17 is rotated counterclockwise by a mechanism not shown. As a result, the document is again conveyed to the glass platen 11 so as to have its other side scanned.

During the above scanning operation, the second master making section 5 operates in the same manner as the first master making section 4. Specifically, after the master discharging operation, the platen roller 43 and conveyor roller pairs 45 and 46 start rotating, paying out the stencil 40 from the roll 41. While the stencil 40 is conveyed via the thermal head 42, it is perforated by the head 42 in the same manner as the stencil 33.

When the leading edge of the stencil 40 reaches a preselected position, as determined in terms of the number of steps of the stepping motor assigned to the platen roller 43, the control means 169 sends a control signal to the opening/closing means in order to rotate the damper 114. As a result, the damper 114 and stage cooperate to nip the leading edge of the stencil 40 therebetween.

Subsequently, the drum 80 is rotated counterclockwise, as viewed in FIG. 4, at a peripheral speed equal to the speed at which the master 40 is conveyed. As a result, the master 40 is sequentially wrapped around the drum 80. When the control means 169 determines, based on the number of the stepping motor, that a single master has been completed, it stops the rotation of the platen roller 43 and conveyor roller pairs 45 and 46. At the same time, the control means 169 causes the movable edge 44*a* to cut the master 40. The cut master 40 is pulled out by the drum 80 in rotation. When the drum 80 again reaches its waiting position or home position, the control means 169 deenergizes the motor 147 and thereby positions the drum 80.

After the masters 33 and 40 have been wrapped around the drums 79 and 80, respectively, the pick-up roller 25, separator rollers 26 and 27 and motors 146 and 147 start rotating. As a result, one paper P is fed from the stack loaded on the tray 24 toward the registration roller pair 30. At the same time, the drums 79 and 80 start rotating at a low speed. The registration roller pair 30 nips the leading edge of the paper P and then rotates at a preselected timing, driving the paper P toward the gap between the drums 79 and 80.

The ink rollers 95 and 117 disposed in the drums 79 and 80, respectively, are rotated by driving means, not shown. In parallel with the above rotation of the drums 79 and 80, the ink rollers 95 and 117 each is angularly moved, as follows. While the solenoid 98 is energized, the drum 79 (flanges 85) is rotated. When the projections of the cam portions 85*c* each contacts the respective cam follower 95*b*, the ink roller 95 is raised, as viewed in FIG. 10. As a result, a gap is produced between the end 99*a* of the stop 99 and the lock rod 94*c*. Then, the solenoid 98 retracts its plunger 98*a* and causes the stop 99 to rotate about the shaft 103 counterclockwise, as viewed in FIG. 10. When the cam followers 95*b* move away from the projections of the cam portions 85*c*, the first and second support members 93 and 94 rotate about the shaft 101 counterclockwise, as viewed in FIG. 10, under the action of the tension springs 104. Consequently, the ink roller 95 abuts against the inner periphery of the porous support 83 and bulges the support 83 and mesh screen 89 downward, as viewed in FIG. 10. At this instant, the sensor 152 sends to the control means 169 a signal indicative of the above angular movement of the ink roller 95.

Further, while the solenoid 120 is energized, the drum 80 (flanges 109 and 110) is rotated. When the projections of the cam portions 109*b* and 110*b* each contacts the respective cam follower 117*b*, the ink roller 117 is lowered, as viewed in FIG. 10. As a result, a gap is produced between the protruding portion 121*b* of the stop 121 and the lock rod 116*c*. Then, the solenoid 120 retracts its plunger 120*a* and causes the stop 121 to rotate about the shaft 125 clockwise, as viewed in FIG. 10. When the cam followers 117*b* move away from the projections of the cam portions 109*b* and 110*b*, the ink roller support member 116 rotates about the shaft 122 clockwise, as viewed in FIG. 10, under the action of the tension springs 123. Consequently, the ink roller 117 abuts against the inner periphery of the porous support 106 and bulges the support 106 and mesh screen upward, as viewed in FIG. 10.

Figure 18:
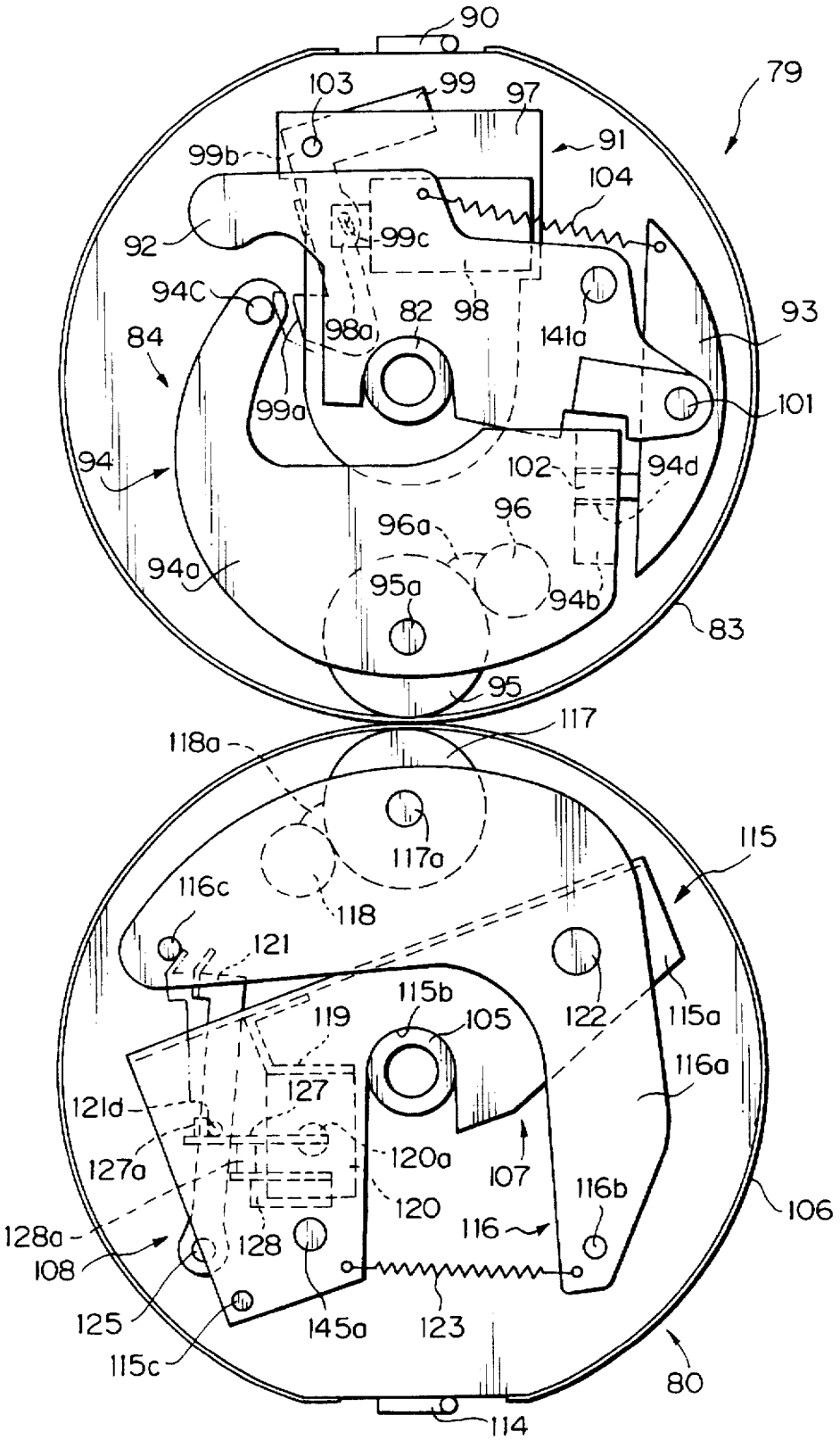
FIG. 18 is a side elevation showing the printing section of the first embodiment in a printing condition.

The registration roller pair 30 feeds the paper P to between the drums 79 and 80 slightly later than the angular movement of the ink rollers 95 and 117 stated above. Consequently, the ink rollers 95 and 117 contact each other with the intermediary of the porous supports 83 and 106, mesh screen 89, mesh screen not shown, masters 33 and 40 and paper P, printing document images on both sides of the paper P. At this instant, the second support member 94 angularly moves about the shaft 102 and causes the ink roller 95 to angularly move, insuring the uniform contact of the rollers 95 and 117 in the axial direction. FIGS. 8 and 18 show the ink rollers 95 and 117 brought into contact with each other.

The paper or printing P carrying the images on both sides thereof is peeled off from the drum 79 or 80 by the peeler 67 or 68, guided by the guides 69 and 70, and then conveyed by the conveyor member 71 to the tray 72.

The drums 79 and 80 continuously rotate even after the above printing operation. After the angular movement of the ink rollers 95 and 117, the control means 169 deenergizes the solenoids 98 and 120. As a result, the stops 99 and 121 are moved by the associated biasing means to dash-and-dots line positions shown in FIG. 18 and where the stops 99 and 121 abut against the lock rods 94*c* and 116*c*, respectively.

When the cam followers 95b again contact the projections of the cam portions 85c due to the rotation of the drum 79, the first and second support members 93 and 94 rotate about the shaft 101 clockwise, as viewed in FIG. 18, releasing the end 99a of the stop 99 from the lock rod 94c. Consequently, the stop 99 returns to the position shown in FIG. 10 due to the action of the biasing means not shown.

Likewise, when the cam followers 117b again contact the projections of the cam portions 109b and 110b due to the rotation of the drum 80, the ink roller support member 116 rotates about the shaft 122 counterclockwise, as viewed in FIG. 18, releasing the tongue 121c of the stop 121 from the lock rod 116c. Consequently, the stop 121 returns to the position shown in FIG. 10 due to the action of the springs 126.

Thereafter, the drums 79 and 80 each rotates to the respective home position and then stops rotating. This brings the entire printer 1 to its waiting or stand-by state. When the operator presses the trial print key 156, the top paper P on the tray 24 is fed out by the pick-up roller 25 and separator rollers 26 and 27, as in the above master wrapping operation. The paper P has its leading edge nipped by the registration roller pair 30. At the same time, the control means 169 energizes the motors 146 and 147 and thereby causes the drums 79 and 80 to rotate at a high speed. The registration roller pair 30 drives the paper P at the same timing as during the master wrapping operation to between the drums 79 and 80 rotating at the high speed. After the document images have been printed on both sides of the paper P, the peeler 67 or 68 peels off the paper P from the drum 79 or 80. The paper or printing P with the images are driven out to the tray 72 by the conveyor member 71. Then, the drums 79 and 80 are returned to their home positions. This is the end of a trial printing procedure.

The operator sees the density and positions of the images of the trial printing P and adjusts them, if necessary, on the various keys on the panel 153 and then produces another trial printing. If the trial printing is acceptable, the operator inputs a desired number of printings on the numeral keys 158, sets a desired printing speed on the print speed keys 161, and then presses the print start key 155. In response, the papers P are continuously fed from the sheet feeding section 3, turning out consecutive printings.

When the amount of the ink existing in the ink well 96a or 118a decreases during the above printing operation, the sensor 170 or 171 sends its output to the control means 169.

In response, the control means 169 operates the ink pump associated with the ink well 96a or 118a. As a result, ink is fed under pressure from the ink pack to the ink well 96a or 118a via the shaft 82 or 105, connecting pipe 131 or 132, and ink feed pipe 129 or 130.

When the operator selects the front print (simplex) mode, the printer 1 operates as follows. When the operator sets a single document on the document tray and then presses the cut start key 154, the first and second master discharging sections 6 and 7 respectively discharge the used masters 167 and 168 from the associated drums 79 and 80, as in the duplex print mode operation. The document scanning section 2 scans the single document.

In parallel with the above scanning operation, the first master making section 4 makes a master 33 in the same manner as during the duplex print mode operation. The master 33 is wrapped around the drum 79. The difference is that the second master making section 5 does not perforate the stencil 40 with the result that a cut length of the stencil 40 is simply wrapped around the drum 80.

After the masters 33 and 40 have been wrapped around the drum 79 and 80, respectively, a single paper P is fed from the paper feeding section 3 while the drums 79 and 80 are caused to rotate at the low speed. Again, the registration roller pair 30 conveys the paper P to between the drums 79 and 80 at the preselected timing.

The ink rollers 95 and 117 angularly move due to the rotation of the associated drums 79 and 80 and cause the porous supports 83 and 106 to protrude, as stated earlier. In this condition, the image of the single document is printed on the paper P. Because the master 40 has not been perforated at all, the document image formed in the master 33 is transferred only to the front or upper surface of the paper P. Then, the paper or simplex printing P is peeled off from the drum 79 by the peeler 67 and then driven out to the tray 72 by the conveyor member 71.

After the drums 79 and 80 have been brought to and stopped at their home positions, i.e., after the master wrapping operation, the operator presses the trial print key 156 for producing a trial printing in the previously stated manner. When the operator presses the print start key 155, the printer 1 starts producing a desired number of printings.

In the rear print (simplex) mode, when the operator sets a single document on the document tray and then presses the cut start key 154, the first and second master discharging sections 6 and 7 respectively discharge the used masters 167 and 168 from the associated drums 79 and 80, as in the duplex mode operation. The document scanning section 2 scans the single document.

In parallel with the above scanning operation, the second master making section 5 makes a master 40 in the same manner as during the duplex mode operation. The master 40 is wrapped around the drum 80. However, the first master making section 4 does not perforate the stencil 33 with the result that a cut length of the stencil 33 is simply wrapped around the drum 79.

After the masters 33 and 40 have been wrapped around the drum 79 and 80, respectively, a single paper P is fed from the paper feeding section 3 while the drums 79 and 80 are caused to rotate at the low speed. Again, the registration roller pair 30 conveys the paper P to between the drums 79 and 80 at the preselected timing.

The ink rollers 95 and 117 angularly move due to the rotation of the associated drums 79 and 80 and cause the porous supports 83 and 106 to protrude. In this condition, the image of the single document is printed on the paper P. Because the master 33 has not been perforated at all, the document image formed in the master 40 is transferred only to the rear or lower surface of the paper P. Then, the paper or simplex printing P is peeled off from the drum 80 by the peeler 68 and then driven out to the tray 72 by the conveyor member 71.

After the drums 79 and 80 have been brought to and stopped at their home positions, i.e., after the master wrapping operation, the operator presses the trial print key 156 for producing a trial printing in the previously stated manner. When the operator presses the print start key 155, the printer 1 starts producing a desired number of printings.

As stated above, in the illustrative embodiment, the shafts 82 and 105 are not movable in any other sense. This eliminates the problem particular to the conventional printer operable in a duplex print mode by causing one drum to move into contact with the other drum. That is, when one drum is moved into contact with the other drum during printing, not only noise is produced, but also the image quality is not stable due to irregular rotation, as discussed earlier.

Further, while the printer 1 is out of operation, the control means 169 causes the stops 99 and 121 to stop the lock rods 94c and 116c, respectively, and thereby maintains the ink rollers 95 and 117 spaced from the porous supports 83 and 106. This is significant in the following respect. Assume that the drums 79 and 80 are rotated without any paper P fed thereto in order to allow ink newly fed from the ink packs to adapt to the surfaces of the ink rollers. Then, the above arrangement protects the surfaces of the perforated masters 33 and 40 wrapped around the drums 79 and 80 from smearing, thereby freeing the non-image area of the paper P from smears at the time of printing. In addition, the porous supports 83 and 106 are spaced from each other while the ink rollers 95 and 117 are held in their inoperative positions, also obviating the above undesirable occurrence.

Further, while the printer 1 is out of operation, the control means 169 maintains the master supports spaced from each other by holding the ink rollers 95 and 117 in their inoperative position and causes the drums 79 and 80 to rotate without a paper P intervening therebetween. Then, masters 33 and 40 existing on the drums 79 and 80 have their surfaces protected from smearing, so the non-image area of a paper P will be freed from smears at the time of printing.

In the above embodiment, the ink feeding means 84 and 107 each is movable relative to each other. Alternatively, an arrangement may be made such that one of the ink feeding means 84 and 107 is movable relative to the other ink feeding means which is fixed in place with its ink roller adjoining the inner periphery of the associated porous support. In such an arrangement, the movable ink feeding means, like the ink feeding means 84, will be supported by a shaft similar to the shaft 102 perpendicular to the shaft 82 or 105 in such a manner as to be angularly movable.

Figure 20:
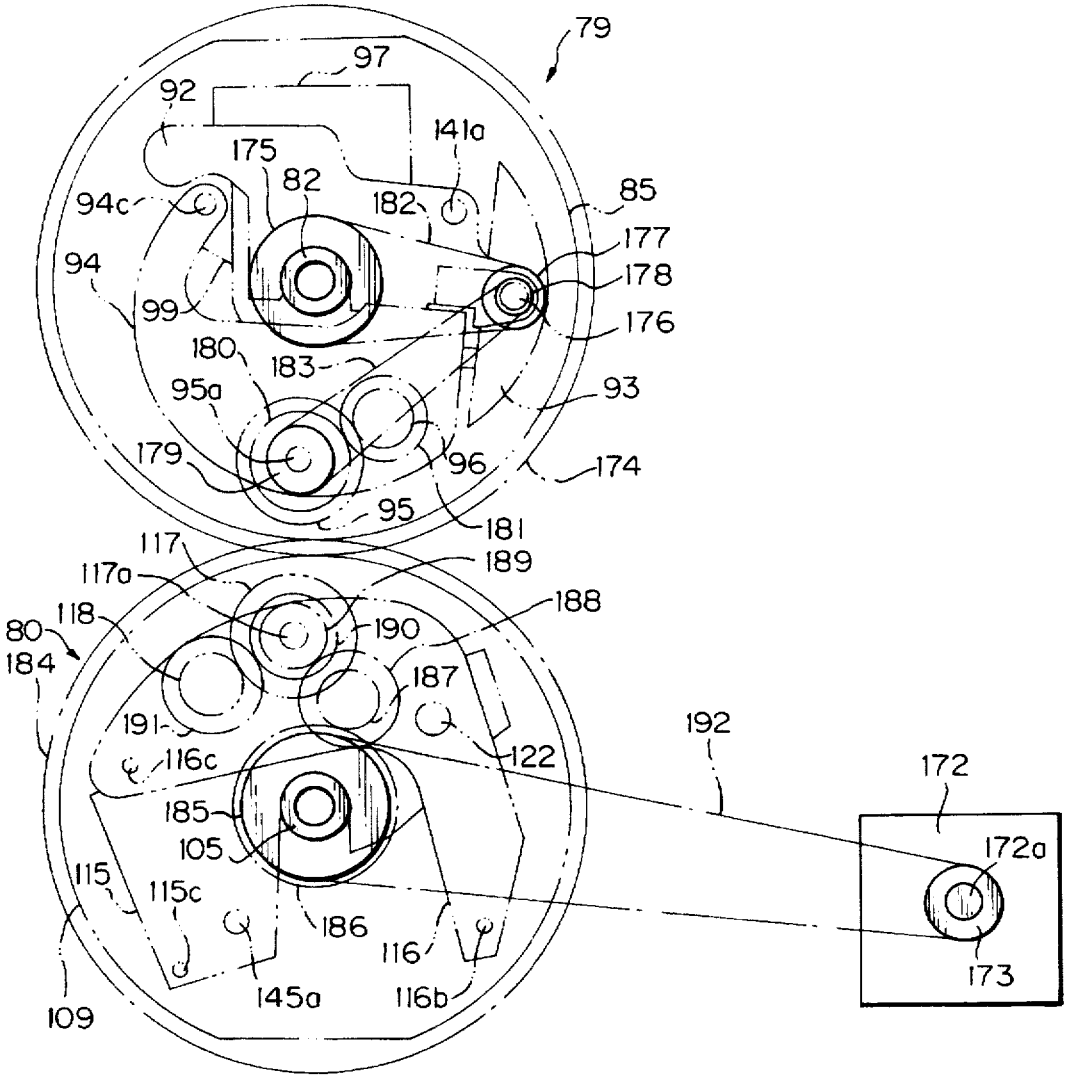
FIG. 20 shows another specific configuration of the drum driving means.

Referring to FIG. 20, a motor or drum driving means 172 applicable to a modification of the above embodiment is shown together with a drive transmission mechanism using the motor 172. As shown, a toothed pulley 173 is mounted on the output shaft 172a of the motor 172. A gear 174 is positioned outside of one flange 85 of the drum 79 in place of the previously stated toothed pulley 137. A toothed pulley 175 is positioned inside of the above flange 85 and inside of the gear 87 and rotatable integrally with the gear 87. The shaft 101 disposed in the drum 79 is replaced with a shaft 176 protruding from the left base 92, as viewed in FIG. 8. A toothed pulley 177 having a large diameter and a toothed pulley 178 having a small diameter are mounted on the end of the shaft 176 protruding from the base 92. A toothed pulley 179 and a gear 180 are mounted on the left shaft 95a, as viewed in FIG. 8, inside of the cam follower 95b. A gear 181 is mounted on the shaft of the doctor roller 96 and held in mesh with the gear 180. Timing belts 182 and 183 are respectively passed over the toothed pulleys 175 and 177 and the toothed pulleys 178 and 179.

A gear 184 is positioned outside of the flange 109 of the drum 80 in place of the toothed pulley 144 and held in mesh with the gear 174. A toothed pulley 185 is located outside of the gear 184 and rotatable integrally with the gear 184. A gear 186 is positioned inside of the flange 109 and inside of the gear 111 and rotatable integrally with the gear 111. The gear 186 is held in mesh with a gear 187 rotatably supported by the side wall 116a. A gear 188 coaxial with the gear 187 is held in mesh with a gear 189 mounted on the shaft 117a. A gear 190 coaxial with the gear 189 is held in mesh with a gear 191 mounted on the shaft of the doctor roller 118. A timing belt 192 is passed over the toothed pulleys 173 and 185.

In operation, when the output shaft 172a of the motor 172 is rotated counterclockwise, as viewed in FIG. 20, its rotation is transmitted to the drum 80 via the toothed pulleys 173 and 185 and timing belt 192, causing the drum 80 to rotate counterclockwise. The rotation of the gear 186, rotating integrally with the toothed pulley 185, is transferred to the ink roller 117 via the gears 187, 188 and 189, causing the ink roller 117 to rotate counterclockwise. The rotation of the ink roller 117 is transferred to the doctor roller 118 via the gears 190 and 191. As a result, the doctor roller 118 rotates clockwise.

Further, the rotation of the gear 184, rotating integrally with the toothed pulley 185, is transferred to the drum 79 via the gear 174, causing the drum 79 to rotate clockwise. The drum 79, in turn, causes the toothed pulley 175 to rotate. The rotation of the pulley 175 is transmitted to the ink roller 95 via the toothed pulleys 177, 178 and 179 and timing belts 182 and 183, causing the ink roller 95 to rotate clockwise. The ink roller 95, in turn, causes the doctor roller 96 to rotate counterclockwise via the gears 180 and 181.

It will be seen that the above modification is capable of driving the drums 79 and 80, ink rollers 95 and 117 and doctor rollers 96 and 118 with a single motor 172. This successfully simplifies the construction and control. Further, because the drums 79 and 80 rotate substantially at the same peripheral speed as each other, the moving speeds, as measured on both sides of the paper P, are substantially the same, enhancing the reproducibility of images. In addition, the velocity differences of the masters 33 and 40 contacting the paper P are equal, protecting the masters 33 and 40 from creasing and stretching. It is to be noted that the various rotatable members are provided with optimal peripheral speeds by the adjustment of the diameters and the numbers of teeth of the gears and toothed pulleys.

Figure 21:
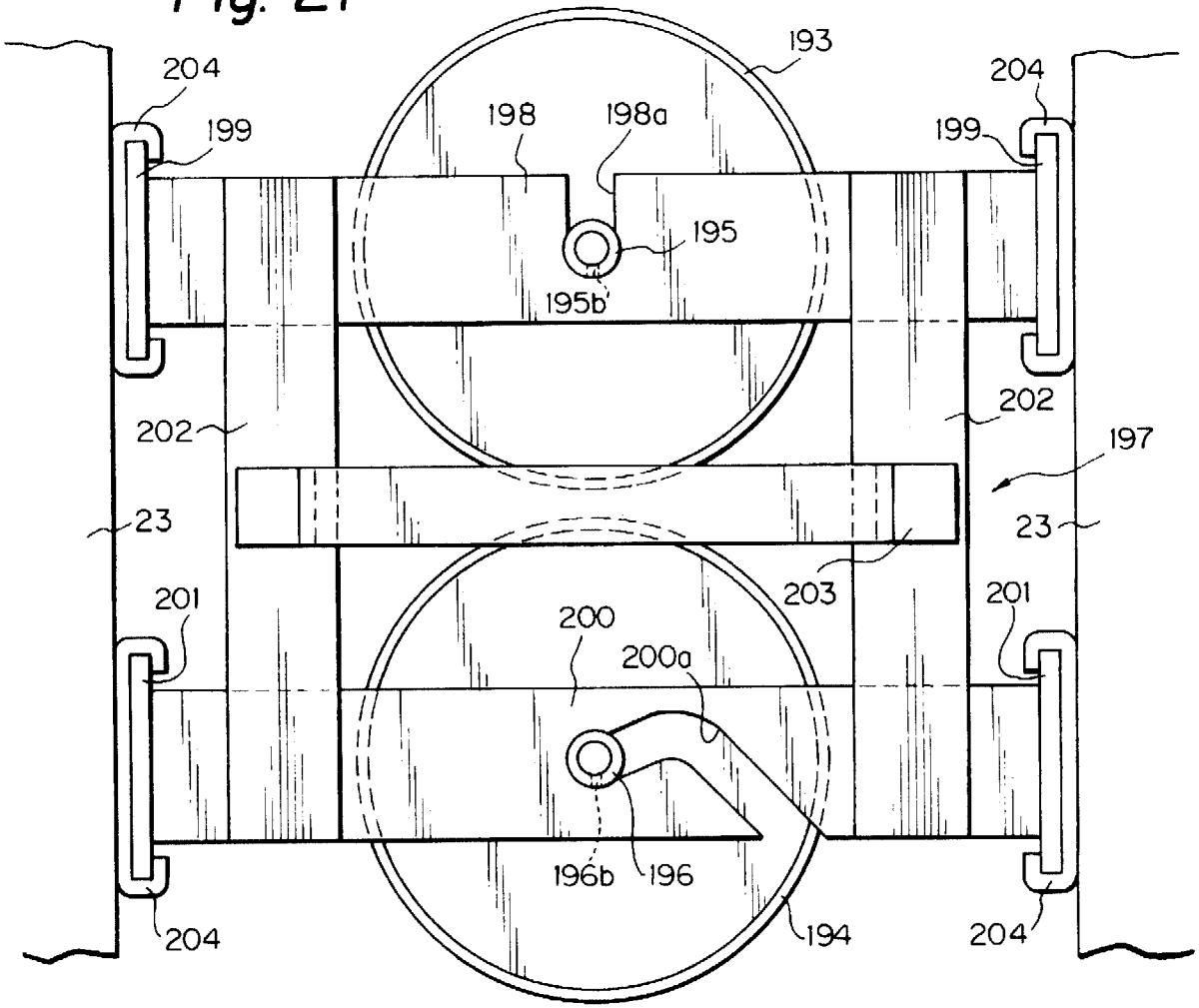
FIG. 21 is a side elevation showing drums and a drum support member representative of a second embodiment of the present invention.

A second embodiment of the stencil printer in accordance with the present invention will be described with reference to FIGS. 21 and 22. As shown, this embodiment includes drums 193 and 194 identical with the drums 79 and 80 except for the following. Shafts 195 and 196 are substituted for the shafts 82 and 105, respectively. Gears 228 and 229 are substituted for the toothed pulleys 137 and 144, respectively. Rotation transmitting members, not shown, are included for transmitting the rotation of the motor 146 and that of the motor 147 to the gears 228 and 229, respectively. The drums 193 and 194 are supported by a single drum support member 197.

The shaft 195 is formed with annular recesses 195a adjacent to its opposite ends, and formed with holes 195b outside of the recesses 195a. Likewise, the shaft 196 is formed with annular recesses 196a and holes 196b. The shafts 195 and 196 each is provided with a detent member or positioning member not shown.

The drum support member 197 includes opposite upper drum support plates 198, opposite upper drum support side plates 199, opposite lower drum support plates 200, opposite lower drum support side plates 201, four tie plates 202, and a handle 203.

The upper drum support plates 198 each is formed with a generally U-shaped notch 198a at its intermediate portion. The notch 198a is open at its upper end and receives one of the annular recesses 195a. The lower drum support plates 200 each is formed with a notch 200a for receiving one of the annular recesses 196a. The notch 200a extends upward leftward from the center and then extends downward leftward, as illustrated. The upper drum support plates 198 are connected together by the upper drum support side plates 199. Likewise, the lower drum support plates 200 are connected together by the lower drum support side plates 201. The side plates 199 and 201 extend upward and downward over the upper ends and lower ends of the upper drum support plates 198 and those of the lower drum support plates 200, respectively. One of the upper drum support plates 198 (located at the front side of the printer) and one of the lower drum support plates 200 beneath the above plate 198 are connected together by two of the tie plates 202. The other upper drum support plate 198 and the other lower drum support plate 200 are connected together by the other two tie plates 202. The handle 203 is affixed at both ends thereof to the tie plates 202 connecting the support plates 198 and 200 located at the front side of the printer.

Four rails 204 are mounted on the casing 23 and allow the drum support member 197 to slide thereon. The rails 204 are so configured as to surround the upper and lower ends of the support plates 199 and those of the support plates 201, as illustrated. If desired, the support plates 199 and 201 and rails 204 may be replaced with ACCURIDE (trade name available from Accuride Japan) for use with drawers.

Sensors 205, 206, 207 and 208 are mounted on the rear end of the casing 23 in order to detect the ends of the shafts 195 and 196 when the drums 193 and 194 are mounted to the casing 23. The sensors 205–208 respectively have feelers 205*a*, 206*a*, 207*a* and 208*a* and output signals when the feelers 205*a*–208*a* are pressed. The outputs of the senors 205–208 are sent to control means 209 which will be described.

Figure 23:
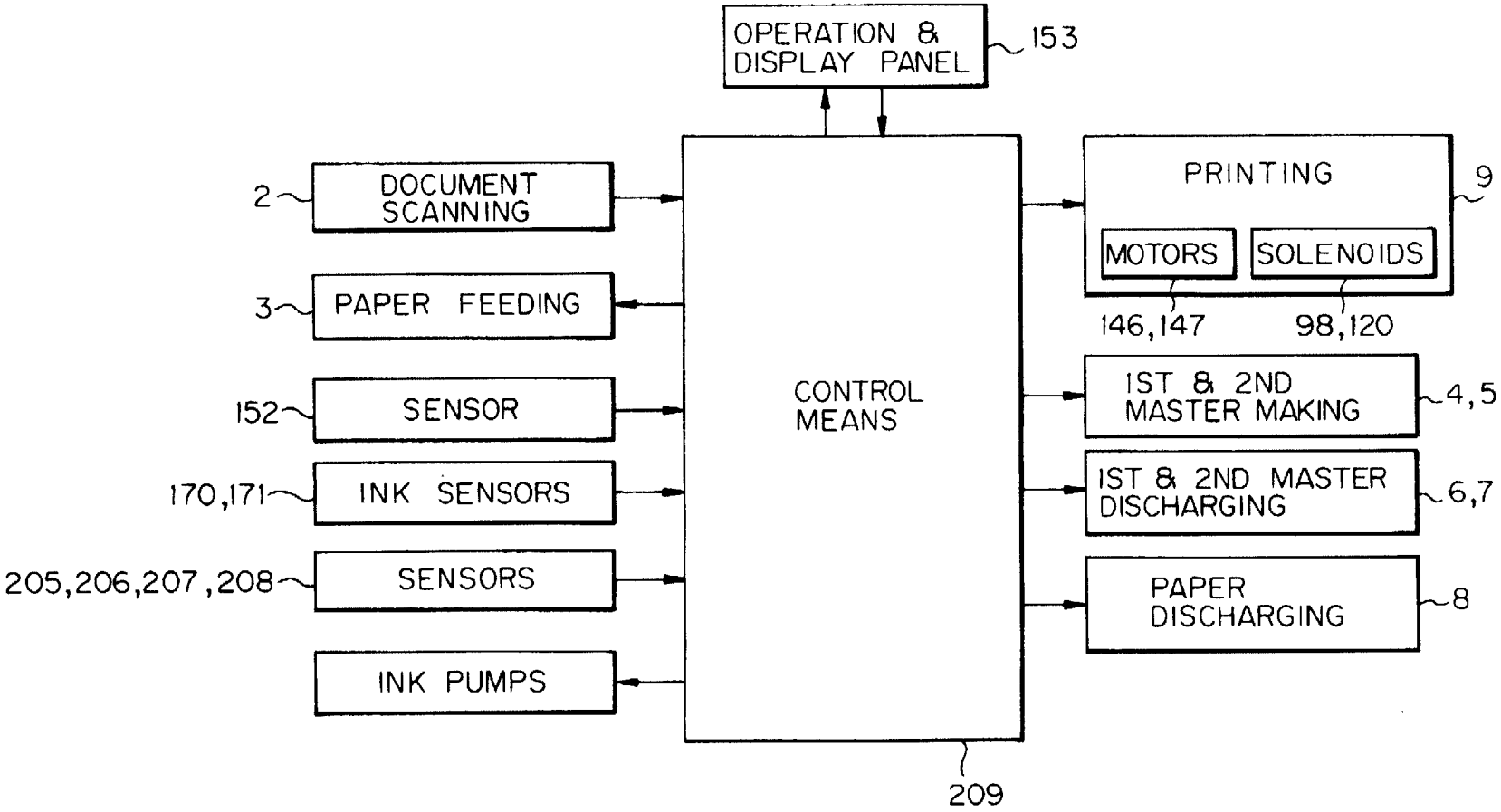
FIG. 23 is a block diagram schematically showing control means included in the second embodiment.

As shown in FIG. 23, the control means 209 included in the control section 10 is identical with the control means 169 of the first embodiment except that it additionally receives the outputs of the sensors 205–208. The control means 209 allow the printer I to operate only when it receives the outputs of all the sensors 205–208.

How the drums 193 and 194 are mounted and dismounted from the casing 23 will be described hereinafter. To dismount the drums 193 and 194, the operator opens a door, not shown, located at the front of the casing 23, holds the handle 203, and then pulls out the drum support member 197 to the right, as viewed in FIG. 22. After the rear ends of the shafts 195 and 196 have appeared, the operator removes the drums 193 and 194 from the support member 197.

Figure 24:
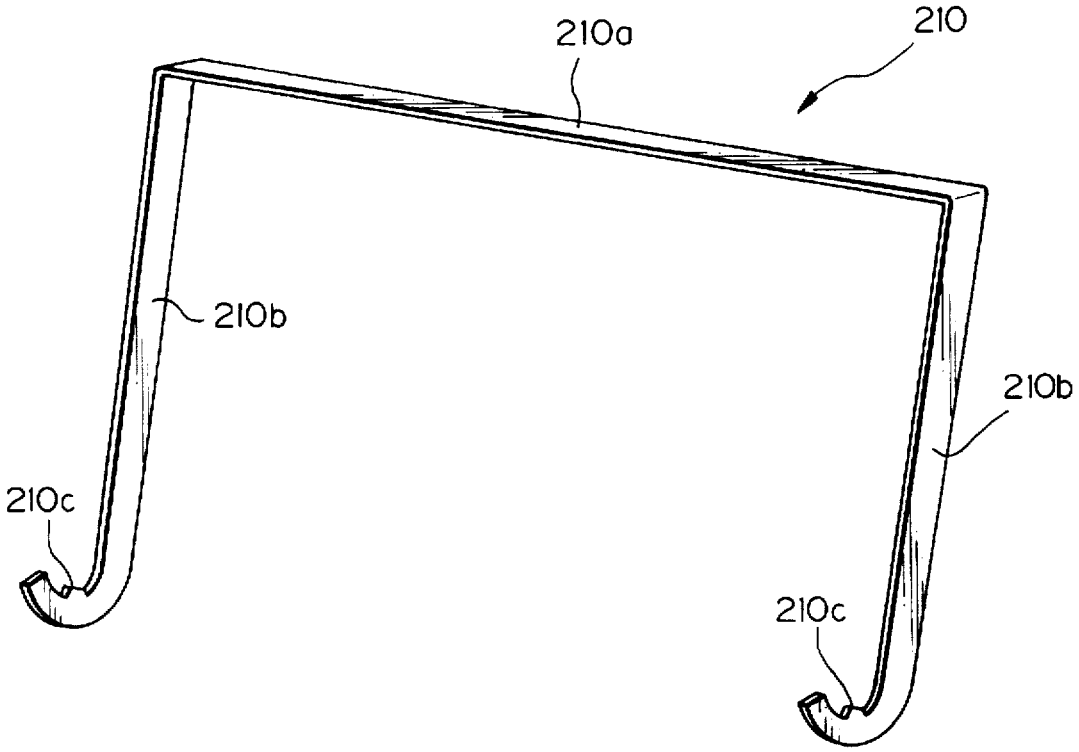
FIG. 24 is a perspective view of a removing member applicable to any one of the second and third embodiments.

To remove the drums 193 and 194 from the support member 197, use is made of a removing member 210 shown in FIG. 24 specifically. As shown, the removing member 210 has a grip portion 210*a* and legs 210*b* extending out from opposite ends of the grip portion 210*a* and each having a generally U-shaped end. The U-shaped ends of the legs 210*b* are coincident with the contour of the shafts 195 and 196. Lugs 210*c* each protrudes from the U-shaped end of the respective leg 210*b* and is engageable with one of the holes 195*b* or holes 196*b*. The distance between the legs 210*b* is equal to the distance between the holes 195*b* or holes 196*b*.

To remove the drum 193, the operator holds the grip portion 210*a* of the removing member 210, fits the lugs 210*c* in the holes 195*b*, and then lifts the member 210 until the drum 193 has been released from the drum support member 197. To remove the other drum 194, after fitting the lugs 210*c* in the holes 196*b*, the operator lifts the removing member 210 upward rightward and then slides it downward rightward along the notches 200*a*.

The drums 193 and 194 are mounted to the drum support member 197 by a procedure opposite to the above dismounting procedure. When the annular recesses 195*a* of the shaft 195, for example, are received in the notches 198*a*, the previous detent members or positioning members, not shown, position the shaft 195 such that the holes 195*b* are brought to the positions shown in FIG. 21. This is also true with the other drum 194 except for the replacement of the shaft 195, recesses 195*a* and notches 198*a* with the shaft 196, recesses 196*a* and notches 200*a*, respectively. In this condition, clampers, not shown, provided on the two drums 193 and 194 face each other.

Assume that the operator inserts the drum support member 197 loaded with the drums 193 and 194 into the casing 23 until the ends of the shafts 195 and 196 have been positioned by the positioning members 134. Then, the ends of the shafts 195 and 196 push the feelers 205*a*–208*a* of the sensors 205–208. As a result, the sensors 205–208 send their outputs to the control means 209. In response, the control means 209 brings the printer 1 to its stand-by state.

With the above mounting and dismounting procedures, the operator can replace the drums 193 and 194 and therefore colors easily. Again, gears similar to the gears 174 and 184 may be positioned outboard of the drums 193 and 194 in order to implement the synchronous rotation with a single driving means.

Figure 25:
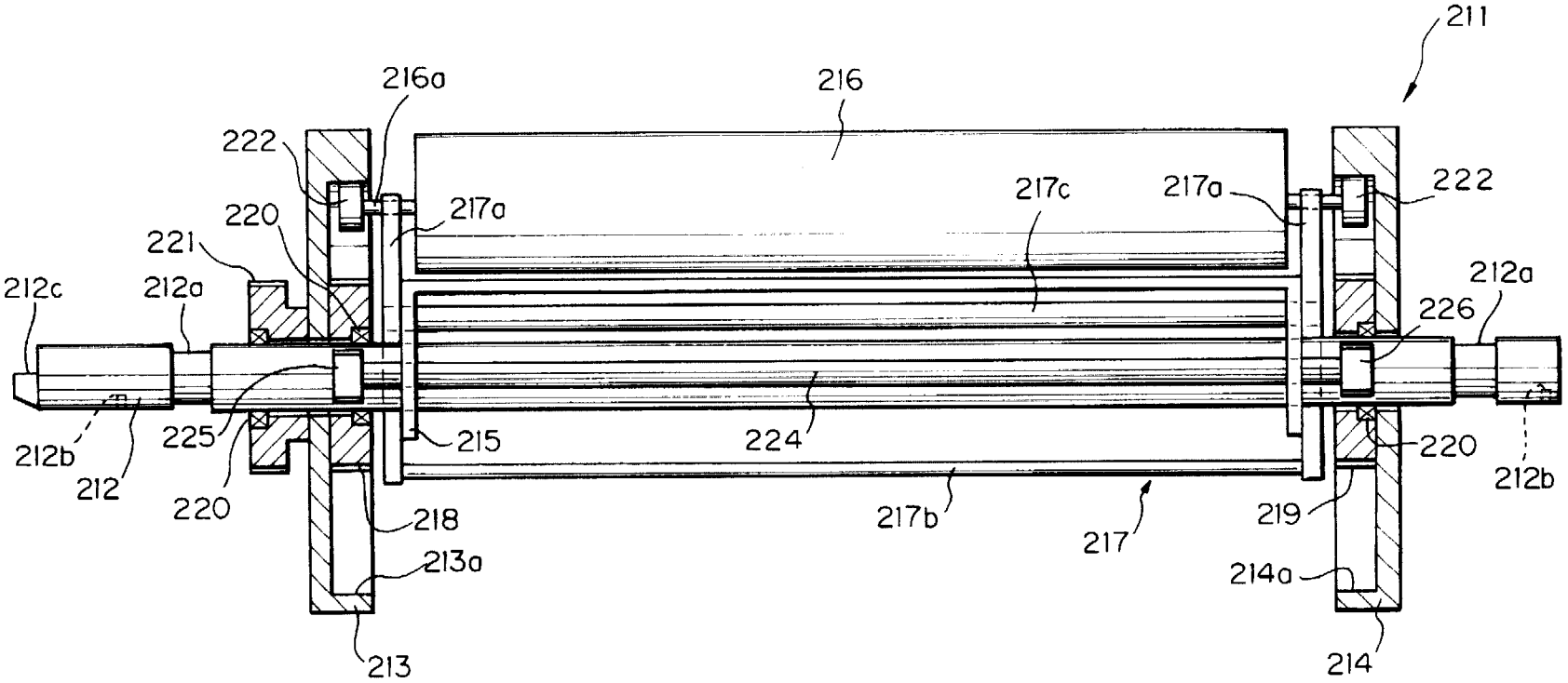
FIG. 25 is a partly sectional front view showing a press roller unit representative of a third embodiment of the present invention in a non-printing condition.
Figure 26:
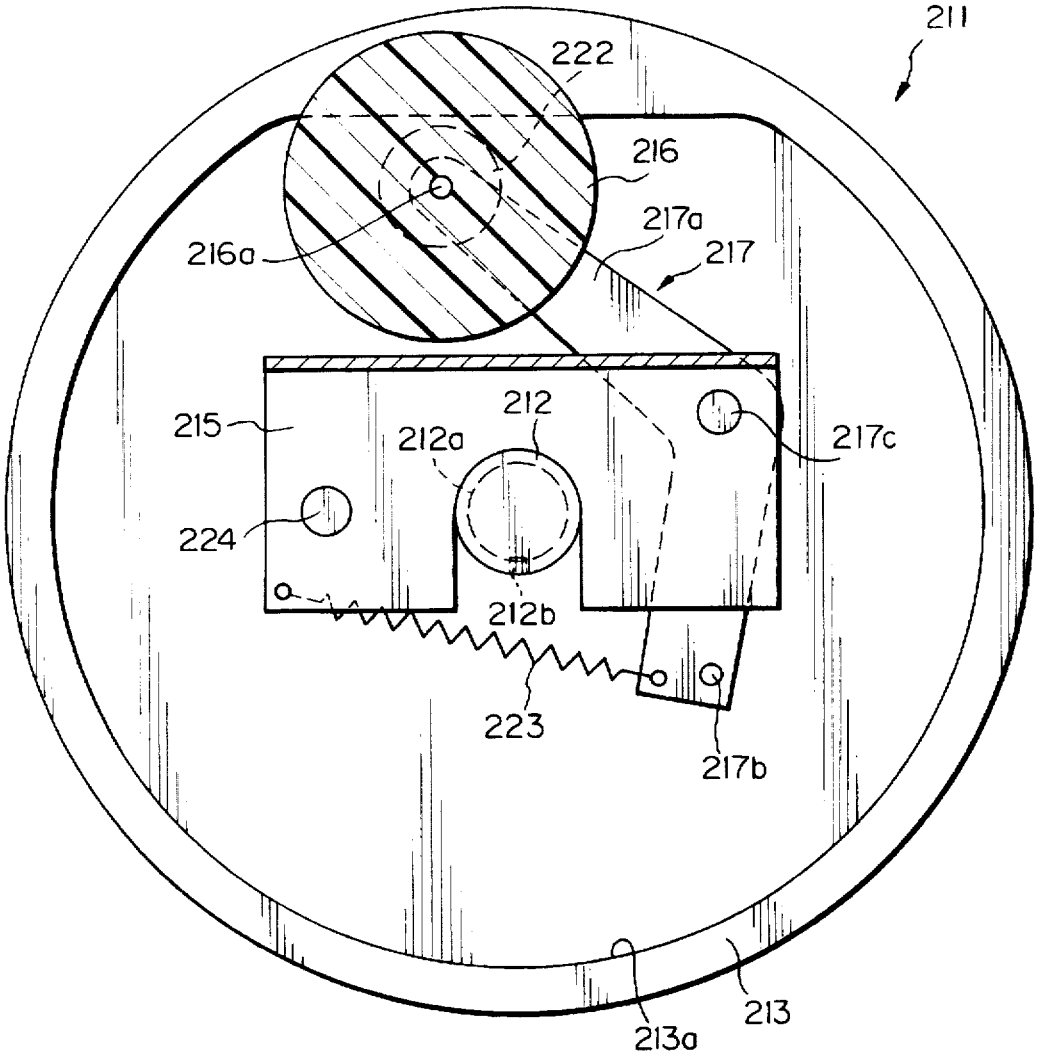
FIG. 26 is a sectional side elevation of the press roller unit shown in FIG. 25.

Referring to FIGS. 25 and 26, a press roller unit 211 representative of a third embodiment of the present invention will be described. The press roller unit 211 is substituted for the drum 194 of the second embodiment and also supported by the drum support member 197. As shown, the press roller unit 211 includes a solid shaft 212, two identical flanges 213 and 214, a base 215, a press roller 216, and a press roller support member 217.

The shaft 212 is formed with annular recesses 212*a* at the same positions as the annular recesses 196*a* of the shaft 196. Holes 212*b* are formed in the shaft 212 in the same positions as holes 196*b* of the shaft 196. The left end of the shaft 212, as viewed in FIG. 25, is formed with a notch 212*c*. Detent members or positioning members, not shown, are provided on the shaft 212.

The flanges 213 and 214 respectively have gears 218 and 219 on their inner surfaces facing each other. The flanges 213 and 214 are rotatably mounted on the shaft 212 via bearings 220. A gear 221 is rotatably mounted on the shaft 212 via a bearing 220 outside of and integrally with the flange 213. Circumferential cam portions 213*a* and 214*a* are respectively formed on the inner surfaces of the flanges 213 and 214.

A base 215 is positioned between the gears 218 and 219 and implemented as a generally C-shaped sheet. The base 215 is affixed to the shaft 212 by affixing members, not shown. A shaft 224 is rotatably supported by the base 215. Gears 225 and 226 are mounted on both ends of the shaft 224 and respectively held in mesh with the gears 218 and 219.

The press roller support member 217 intervenes between both side walls of the base 215 and the gears 218 and 219. The support member 217 has generally V-shaped opposite support plates 217*a* and a tie rod 217*b* connecting one end of the support plates 217*a*. The support member 217 is rotatably supported by the base 215 via a shaft 217*c* at the bent portions of the support plates 217*a*. Tension springs 223 each is anchored to the above end of one of the support plates 217*a* at one end and to the base 215 at the other end.

The press roller 216 has at least its circumferential surface formed of rubber or similar elastic material. The press roller 216 is rotatably supported by the other ends of the support plates 217*a* via a shaft 216*a*. Both ends of the shaft 216*a* protrude from the support plates 217*a* and carry rotatable cam followers 222 thereon. The tension springs 223 constantly urge the cam followers 222 against the cam portions 213*a* and 214*a*.

Figure 27:
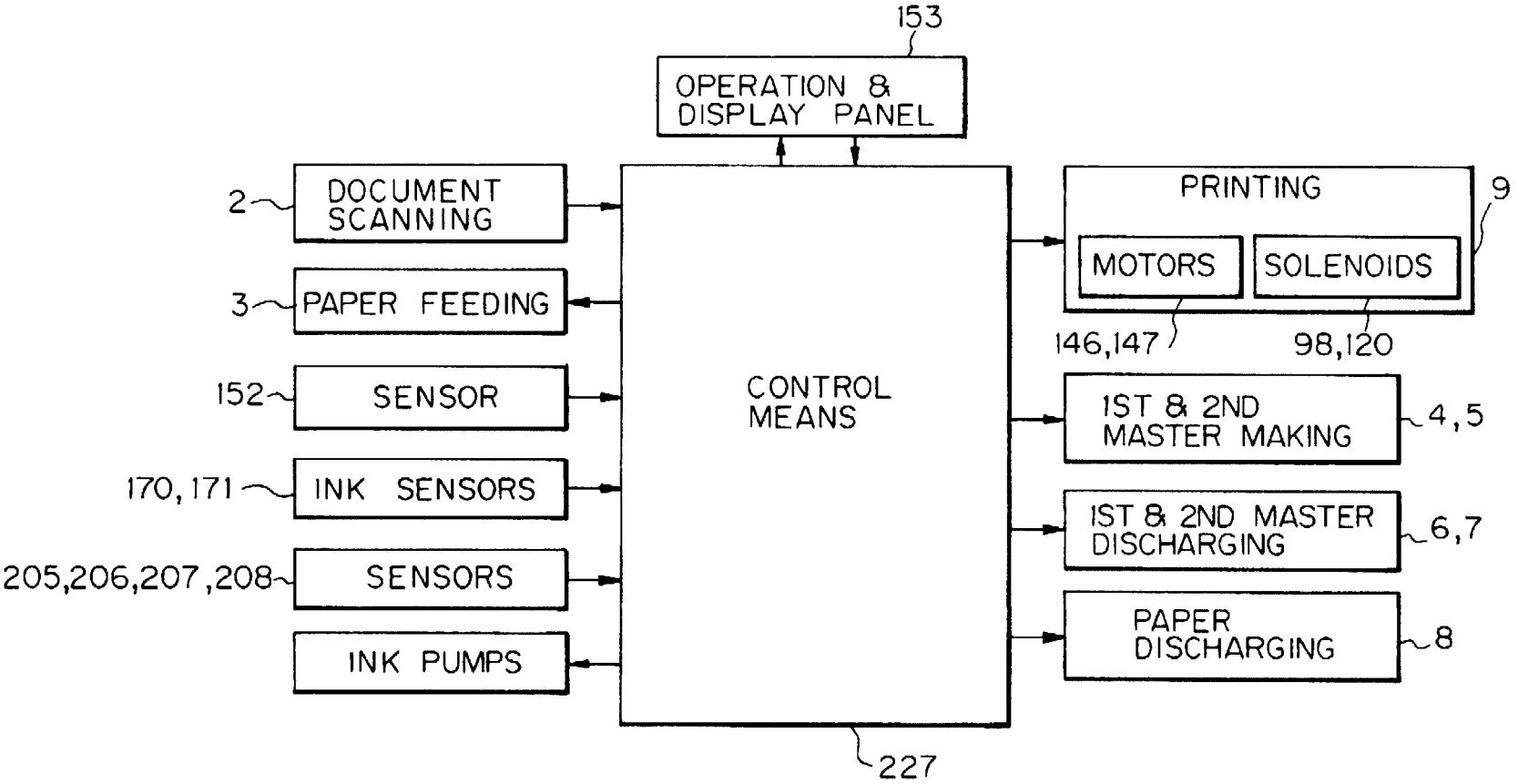
FIG. 27 is a block diagram schematically showing control means included in the third embodiment.

FIG. 27 shows control means 227 included in the third embodiment. When the outputs of all the sensors 205–208 are input to the control means 227, the control means 227 sends a control signal to the print mode displaying means 166 of the operation and display panel 153. In response, the displaying means 166 displays the duplex print mode. Then, the control means 227 causes the printer 1 to operate in the duplex print mode. When the output of the sensor 207 alone is not input to the control means 227, the control means 227 causes the print mode displaying means 166 to display the front (simplex) print mode and causes the printer 1 to operate in the front print mode. Specifically, in the front print mode, the control means 227 is so programmed as not to send its output to the second master making section 5 and second master discharging section 7 even when the cut start key 154 is pressed. Further, the control means 227 is so programmed as to invalidate inputs on the cut start key 154 and print start key 155 if at least one of the sensors other than the sensor 207 does not send its output to the control means 227.

Figure 22:
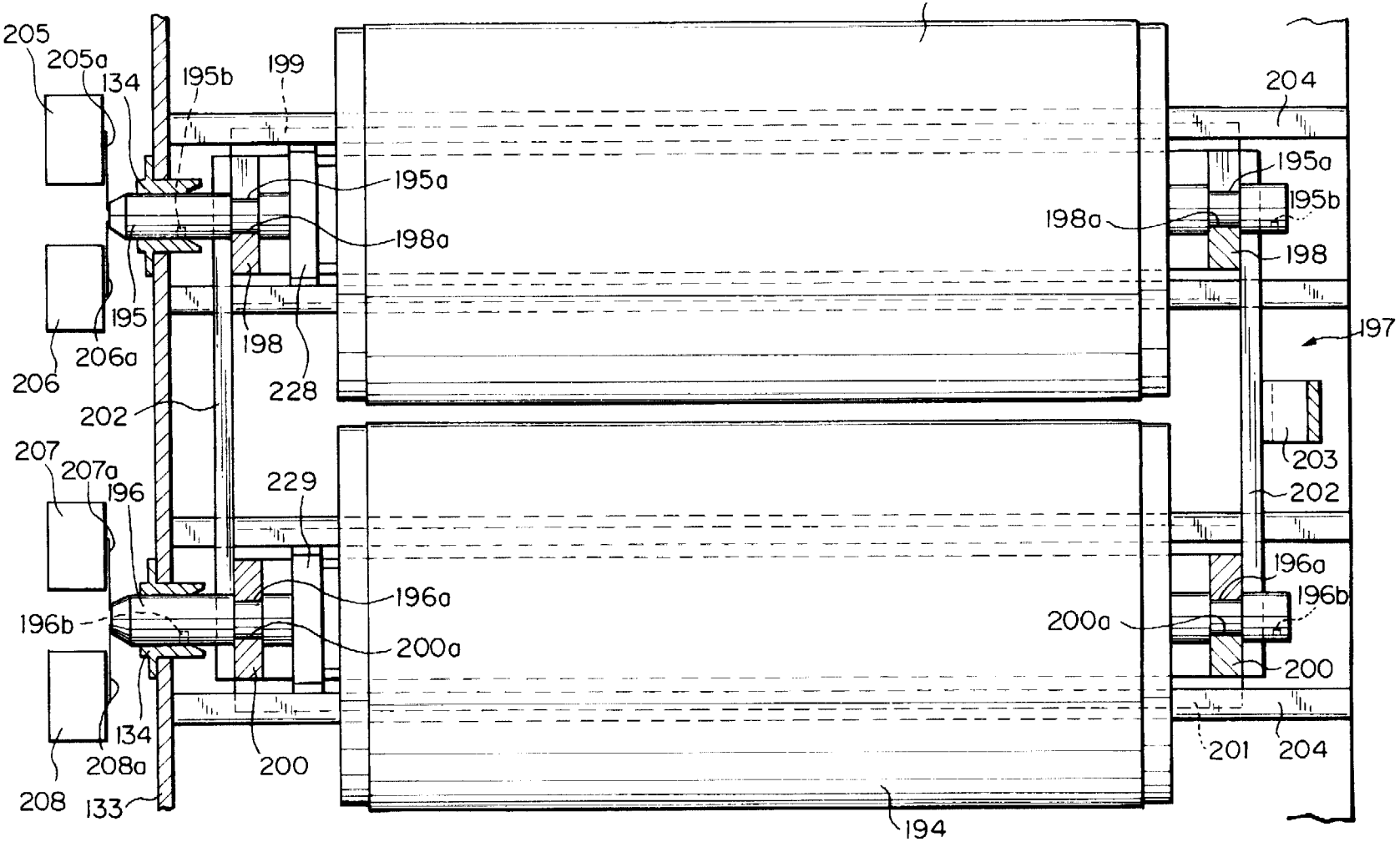
FIG. 22 is a section of the drums and drum support member shown in FIG. 21.
Figure 28:
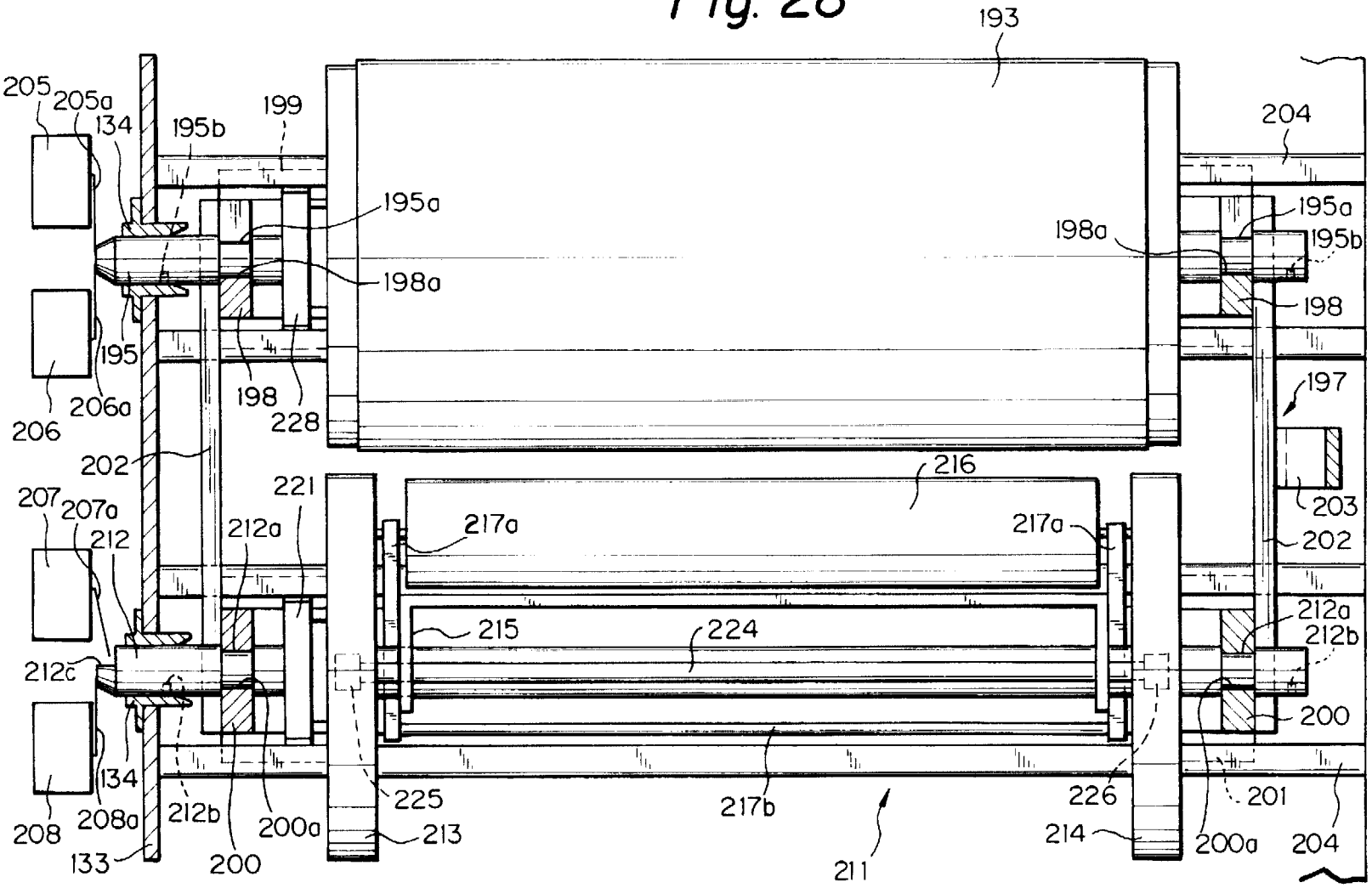
FIG. 28 is a front view showing an essential part of the third embodiment in a non-printing condition.

Reference will be made to FIGS. 22 and 28 for describing how the press roller unit 211 is mounted and dismounted from the casing 23. The operator opens the door of the casing 23, holds the grip portion 203, and then pulls out the drum support member 197 to the right, as viewed in FIG. 22, as stated earlier. After the rear ends of the shafts 195 and 196 have appeared, the operator removes the drum 194 from the support member 197 in the same manner as in the second embodiment.

After the removal of the drum 194, the operator mounts the press roller unit 211 to the support member 197. When the annular recesses 212*a* of the shaft 212 are received in the notches 200*a*, the detent members or positioning members position the press roller unit 211 such that the holes 212*b* lie at the positions shown in FIG. 28 and where the lugs of the cam portions 213*a* and 214*a* are located at the top.

Assume that the operator inserts the drum support member 197 loaded with the drum 193 and press roller unit 211 into the casing 23 until the ends of the shafts 195 and 212 have been positioned by the positioning members 134. Then, the ends of the shafts 195 and 212 push the feelers 205*a*, 206*a* and 208*a* of the sensors 205, 206 and 208. As a result, the sensors 205, 206 and 208 send their outputs to the control means 227. At this instant, because the feeler 207*a* is not pushed due to the notch 212*c* of the shaft 212, the sensor 207 does not send its output to the control means 227. Therefore, the control means 227 causes the print mode displaying means 166 to display the front (simplex) print mode and reads a program assigned to the front print mode.

While the printer 1 is in its stand-by state, the operator sets a single document on the document tray, not shown, and then presses the cut start key 154. In response, the motor 146 is energized to rotate the drum 193 with the result that a used master is removed from the drum 193 by the upper and lower master discharge members 47 and 48. This master discharging operation ends when the drum 193 is rotated to its home position and then stopped. At this instant, the control means 227 does not send any control signal to the second master discharging section 7, maintaining the motor 147, upper and lower master discharge members 57 and 58 and compressor 60 inoperative. The document scanning section 2 scans the document conveyed in the manner stated previously.

In parallel with the document scanning operation, the first master making section 4 makes a master in the same manner as during duplex print mode operation described in relation to the first embodiment. The resulting master 33 is wrapped around the drum 193. The control means 227 does not send any control signal to the second master making section 5, maintaining the thermal head 42, platen roller 43, cutting means 44 and conveyor roller pairs 45 and 46 inoperative.

Subsequently, a single paper P is fed from the paper feeding section 3 while the motors 146 and 147 are energized. As a result, the drum 193 is rotated at the low speed while the gear 221 is rotated in the opposite direction to the drum 193, as in the second embodiment. The gear 218 is rotated integrally with the gear 221. The rotation of the gear 218 is transferred to the gear 219 via the gear 225, shaft 224 and gear 226, causing the flanges 213 and 214 to rotate in synchronism. The registration roller pair 30 drives the paper P to between the drum 193 and press roller 216 at the previously stated timing.

Figure 29:
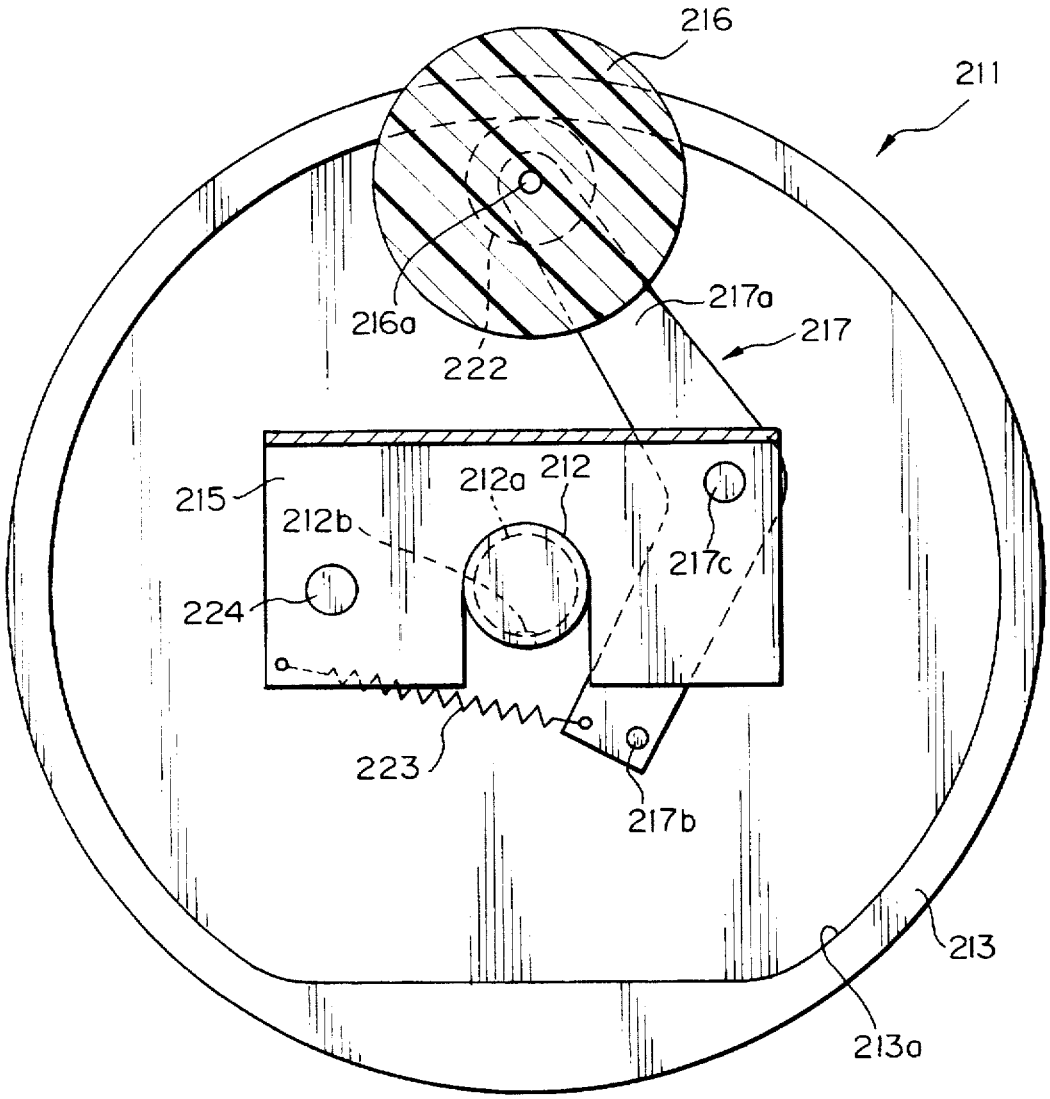
FIG. 29 is a sectional side elevation showing the press roller unit of FIG. 25 in a printing condition.

The ink roller 95 disposed in the drum 193 is angularly moved due to the rotation of the drum 193, as in the first embodiment. The ink roller 95 bulges the porous support 83 and mesh screen 89 toward the press roller 216. At the same time, the cams 213*a* and 214*a* are rotated by the flanges 213 and 214. When the lugs of the cam portions 213*a* and 214*a* and the cam followers 222 are released from each other, the circumference of the press roller 216 protrudes outward over the circumferences of the flanges 213 and 214 due to the bias of the tension springs 223, as shown in FIG. 29. It should be noted that the press roller 216 protrude in synchronism with the bulging of the porous support 83 and mesh screen 89.

The registration roller pair 30 drives the paper P slightly later than the bulging of the porous support 83 and mesh screen 89 and the protruding of the press roller 216. As a result, the ink roller 95 and press roller 216 contact each other with the intermediary of the support 83, mesh screen 89, master 33, and paper P, printing a document image on the paper P. Then, the paper or printing P is peeled off from the drum 193 by the peeler 67 and conveyed by the conveyor member 71 to the tray 72.

Thereafter, the cam followers 95*b* again contact the lugs of the cam portions 85*c*, as in the first embodiment. As a result, the ink roller 95 is released from the porous support 83. At the same time, the cam followers 222 again contact the lugs of the cam portions 213*a* and 214*a*, causing the circumference of the press roller 216 to retract to the inside of the circumferences of the flanges 213 and 214.

The motors 146 and 147 are deenergized substantially at the same time as the ink roller 95 is released from the porous support 83 and the press roller 216 is retracted. This is the end of the master wrapping operation. When the operator presses the trial print key 156 or the print start key 155, the printer 1 operates in the same manner as in the first embodiment, producing a trial printing or a desired number of regular printings.

As stated above, this embodiment is operable in the simplex print mode without resorting to a non-perforated master. This is desirable from the cost standpoint.

In the illustrative embodiment, the press roller 216 included in the press roller unit 211 is movable over the circumferences of the flanges 213 and 214, as needed. Alternatively, use may be made of a press roller unit whose press roller is rotatable, but fixedly located at a position outside of the circumferences of the flanges 213 and 214.

In the above embodiment, the ink roller 95 disposed in the drum 193 is angularly movable. If desired, the drum 193 may be replaced with a drum accommodating a conventional ink roller not angularly movable.

When the press roller unit 211 is replaced with the drum 194, the drums 193 and 194 will be driven in synchronism by a single driving means only if gears similar to the gears 174 and 184 are respectively located outboard of the drums 193 and 194, as stated previously. In such a case, the gear 221 outboard of the flange 213 of the press roller unit 211 may be replaced with a gear similar to the gear 184.

In summary, it will be seen that the present invention provides a stencil printer having various unprecedented advantages as enumerated below.

(1) Control means moves either one of two ink rollers from its inoperative position to its operative position and thereby bulges either one of a first and a second flexible master support. As a result, the two master supports are pressed against each other with the intermediary of a paper. This not only obviates noise ascribable to the intermittent contact of two drums during duplex print mode operation, but also eliminates defective images ascribable to irregular rotation. Further, assume that while the printer is out of printing operation, the control means maintains the master supports spaced from each other by holding the ink rollers in their inoperative positions, and causes the drums to rotate without a paper intervening therebetween. Then, masters existing on the drums have their surfaces protected from smearing, so the non-image area of a paper will be freed from smears at the time of printing.

(2) The control means moves a first and a second ink roller from their inoperative positions to their operative positions and thereby bulge the first and second master supports. As a result, the two master supports are pressed against each other with the intermediary of a paper. This not only obviates noise ascribable to the intermittent contact of the two drums during duplex print mode operation, but also eliminates defective images ascribable to irregular rotation. Further, assume that while the printer is out of operation, the control means maintains the master supports spaced from each other by holding the ink rollers in their inoperative positions, and causes the drums to rotate without a paper intervening therebetween. Then, masters existing on the drums have their surfaces protected from smearing, so the non-image area of a paper will be freed from smears at the time of printing.

(3) The control means moves either one of the two ink rollers from its inoperative position to its operative position and thereby bulges either one of the first and second master supports. As a result, the two master supports are pressed against each other with the intermediary of a paper. This not only obviates noise ascribable to the intermittent contact of two drums during duplex print mode operation, but also eliminates defective images ascribable to irregular rotation. Further, assume that while the printer is out of operation, the control means maintains the ink rollers spaced from the inner peripheries of the associated master supports. Then, when the drums are rotated without a paper intervening therebetween, masters existing on the drums have their surfaces protected from smearing, so the non-image area of a paper will be freed from smears at the time of printing.

(4) Because the first and second drums are supported by a single drum support member, colors can be easily replaced at the time of printing.

(5) The control means sets up a simplex print mode when a press roller unit is mounted to the drum support member, or sets up a duplex print mode when the first and second drums are mounted to the same. Therefore, simplex copy mode operation can be effected without using a non-perforated master, so that the cost is cut down. Further, during duplex mode operation, there can be obviated not only noise ascribable to the intermittent contact of two drums during duplex print mode operation, but also defective images ascribable to irregular rotation. Further, assume that while the printer is out of operation, the control means maintains the ink rollers in their inoperative positions, and causes the drums to rotate without a paper intervening therebetween when the master supports are spaced from each other. Then, masters existing on the drums have their surfaces protected from smearing, so the non-image area of a paper will be freed from smears at the time of printing.

(6) First and second master making means and first and second master conveying means are provided, implementing master making and duplex printing continuously.

(7) The control means maintains the master making means and master conveying means associated with one drum inoperative. This obviates defective master making.

(8) The first and second ink rollers each has its both ends rotatably supported by a respective ink roller support member. One of the ink roller support members has its central portion supported by first or second ink feeding means such that the associated ink roller is angularly movable in a plane containing the axis of rotation of the ink roller and the radius of the first or the second drum. Therefore, the two ink rollers can contact each other uniformly in the axial direction thereof, allowing uniform images to be formed on both sides of a paper at the same time.

(9) The first and second drums are rotated in synchronism by a single driving means. Therefore, the peripheries of the drums move at substantially the same speed on both sides of a paper, enhancing the reproducibility of images. Further, the masters contacting the paper move at the same speed, and are therefore free from creasing and stretching. In addition, the construction and control of the printer are simplified.

(10) The first and second ink feeding means respectively have first and second ink sensing means and first and second ink supply members. Therefore, the amount of ink in each of the two ink feeding means remains constant, insuring attractive printings free from blurring or spreading.

(11) Because the two master supports are implemented as porous thin sheets of metal, they are protected from deformation and breakage during printing and enhance the durability of the printer.

(12) After used masters have been removed from the drums, the drums are rotatable with the master support pressingly contacting each other. This insures a uniform ink layer on the surface of each master support and thereby renders even the first printing produced after a long time of suspension clear-cut.

Various modifications will become possible for those skilled in the art after receiving the teachings of the present disclosure without departing from the scope thereof. For example, the embodiments shown and described each positions the circumferences of the ink rollers G and H in close proximity to the inner peripheries of the master supports C and D, respectively, as indicated by solid lines in FIG. 1. Alternatively, the circumferences of the ink rollers G and H may contact the inner peripheries of the master supports C and D, as shown in FIG. 2, or may be pressed against the inner peripheries of the master supports C and D, as shown in FIG. 3.

What is claimed is:

1. A stencil printer comprising:

a first drum including a first flexible master support;

a second drum including a second flexible master support and having a circumferential surface adjoining said first drum;

first ink feeding means arranged in said first drum and including a first ink roller capable of rotating in pressing contact with an inner periphery of said first master support;

second ink feeding means arranged in said second drum and including a second ink roller capable of rotating in pressing contact with an inner periphery of said second master support; and control means for controlling said first and second drums and said first and second ink feeding means;

said first ink roller or said second ink roller being supported by said first ink feeding means or said second ink feeding means in such a manner as to be movable between an inoperative position not causing said first and second master supports to contact each other and an operative position causing said first and second master supports to pressingly contact each other;

said control means moving, when a paper is passed between said first and second drums for printing, at least one of said first and second ink rollers from said inoperative position to said operative position to thereby bulge said first master support or said second master support, whereby said first and second master supports are brought into pressing contact with each other with the intermediary of the paper.

2. A stencil printer as claimed in claim 1, wherein said first and second drums are supported by a drum support member removably mounted to a casing of said stencil printer.

3. A stencil printer as claimed in claim 1, wherein said first and second ink rollers each has opposite ends thereof rotatably supported by a respective ink roller support member, one of the ink roller support members being supported by said first ink feeding means or said second ink feeding means at a central portion thereof such that the ink roller is angularly movable in a plane containing an axis of said ink roller and a radius of said first drum or said second drum.

4. A stencil printer as claimed in claim 1, wherein said first and second drums are caused to rotate in synchronism with each other by a single driving means.

5. A stencil printer as claimed in claim 1, wherein said first and second ink feeding means respectively comprise first and second ink sensing means respectively responsive to amounts of ink existing in said first and second ink feeding means, and a first and a second ink supply member for respectively supplying the ink to said first and second ink feeding means, said control means controlling said first and second ink supply members in response to outputs of said first and second ink sensing means.

6. A stencil printer comprising:

a first drum including a first flexible master support;

a second drum including a second flexible master support and having a circumferential surface adjoining said first drum;

first ink feeding means arranged in said first drum for feeding ink to said first drum, and including a first ink roller selectively movable between a first inoperative position preventing said first master support from contacting said second master support and a first operative position bulging said first master support into pressingly contact with said second master support;

second ink feeding means arranged in said second drum for feeding ink to said second drum, and including a second ink roller selectively movable between a second inoperative position preventing said second master support from contacting said first master support and a second operative position bulging said second master support into pressing contact with said first master support;

first ink roller moving means for moving said first ink roller from said first inoperative position to said first operative position;

second ink roller moving means for moving said second ink roller from said second inoperative position to said second operative position; and control means for causing, when a paper is passed between said first and second drums for printing, said first and second ink roller moving means to respectively move said first and second ink rollers to said first and second operative positions to thereby bulge said first and second master supports into pressing contact with each other with the intermediary of the paper.

7. A stencil printer as claimed in claim 6, wherein said first and second drums are supported by a drum support member removably mounted to a casing of said stencil printer.

8. A stencil printer as claimed in claim 6, wherein said first and second ink rollers each has opposite ends thereof rotatably supported by a respective ink roller support member, one of the ink roller support members being supported by said first ink feeding means or said second ink feeding means at a central portion thereof such that the ink roller is angularly movable in a plane containing an axis of said ink roller and a radius of said first drum or said second drum.

9. A stencil printer as claimed in 6, wherein said first and second drums are caused to rotate in synchronism with each other by a single driving means.

10. A stencil printer as claimed in claim 6, wherein said first and second ink feeding means respectively comprise first and second ink sensing means respectively responsive to amounts of ink existing in said first and second ink feeding means, and a first and a second ink supply member for respectively supplying the ink to said first and second ink feeding means, said control means controlling said first and second ink supply members in response to outputs of said first and second ink sensing means.

11. A stencil printer comprising:

a first drum including a first flexible master support;

a second drum including a second flexible master support and having a circumferential surface adjoining said first drum;

first ink feeding means arranged in said first drum and including a first ink roller capable of rotating in pressing contact with an inner periphery of said first master support;

second ink feeding means arranged in said second drum and including a second ink roller capable of rotating in pressing contact with an inner periphery of said second master support; and control means for controlling said first and second drums and said first and second ink feeding means;

said first ink roller or said second ink roller being supported by said first ink feeding means or said second ink feeding means in such a manner as to be movable between an inoperative position spaced from the inner periphery of said first master support or said second master support and an operative position pressingly contacting said inner periphery;

said control means moving, when a paper is passed between said first and second drums for printing, said first ink roller or said second ink roller from said inoperative position to said operative position to thereby bulge said first master support or said second master support, whereby said first and second master supports are brought into pressing contact with each other with the intermediary of the paper.

12. A stencil printer as claimed in claim 11, wherein said first and second drums are supported by a drum support member removably mounted to a casing of said stencil printer.

13. A stencil printer as claimed in claim 11, wherein said first and second ink rollers each has opposite ends thereof rotatably supported by a respective ink roller support member, one of the ink roller support members being supported by said first ink feeding means or said second ink feeding means at a central portion thereof such that the ink roller is angularly movable in a plane containing an axis of said ink roller and a radius of said first drum or said second drum.

14. A stencil printer as claimed in claim 11, wherein said first and second drums are caused to rotate in synchronism with each other by a single driving means.

15. A stencil printer as claimed in claim 11, wherein said first and second ink feeding means respectively comprise first and second ink sensing means respectively responsive to amounts of ink existing in said first and second ink feeding means, and a first and a second ink supply member for respectively supplying the ink to said first and second ink feeding means, said control means controlling said first and second ink supply members in response to outputs of said first and second ink sensing means.

* * * * *

UNITED STATES PATENT AND TRADEMARK OFFICE

CERTIFICATE OF CORRECTION

PATENT NO. : 5,782,178

DATED : July 21, 1998

INVENTOR(S) : Tomoyo OTOMO

It is certified that error appears in the above-identified patent and that said Letters Patent is hereby corrected as shown below:

Column 5, line 56, change "P.A" to --P. A--

Column 8, line 7, change "damper" to --clamper--

Column 11, line 44, change "the the" to --the--

Column 12, line 28, change "the presses" to --presses--

Column 12, line 65, change "signal undergone" to --signal having undergone--

Column 19, line 25, change "senors" to --sensors--

Column 26, line 31, change "in 6" to --in Claim 6--

Signed and Sealed this

Twenty-eighth Day of September, 1999

*Attest:*

Q. TODD DICKINSON

*Attesting Officer*

*Acting Commissioner of Patents and Trademarks*